US011116048B2

(12) United States Patent
Corrado

(10) Patent No.: US 11,116,048 B2
(45) Date of Patent: Sep. 7, 2021

(54) HEATING DEVICE, ITS USE AND KIT

(71) Applicant: E-Wenco s.r.l., Legnano (IT)

(72) Inventor: Ennio Corrado, Arsago Serprio (IT)

(73) Assignee: E-Wenco s.r.l., Legnano (IT)

( * ) Notice: Subject to any disclaimer, the term of this patent is extended or adjusted under 35 U.S.C. 154(b) by 448 days.

(21) Appl. No.: 16/319,321

(22) PCT Filed: Jul. 14, 2017

(86) PCT No.: PCT/IB2017/054272
§ 371 (c)(1),
(2) Date: Jan. 19, 2019

(87) PCT Pub. No.: WO2018/015856
PCT Pub. Date: Jan. 25, 2018

(65) Prior Publication Data

US 2019/0159299 A1 May 23, 2019

(30) Foreign Application Priority Data

Jul. 18, 2016 (IT) ..... 102016000074867

(51) Int. Cl.
*H05B 6/12* (2006.01)
*H05B 6/06* (2006.01)
*H05B 6/10* (2006.01)

(52) U.S. Cl.
CPC ..... *H05B 6/105* (2013.01)

(58) Field of Classification Search
CPC ..... A47J 36/02; H05B 6/062; H05B 6/12; H05B 6/105
See application file for complete search history.

(56) References Cited

U.S. PATENT DOCUMENTS 3,684,853 A * 8/1972 Welch ..... A47J 36/02 219/624
3,742,174 A * 6/1973 Harnden, Jr. ..... H05B 6/062 219/627
3,781,503 A * 12/1973 Harnden, Jr. ..... H05B 6/062 219/622
3,786,219 A * 1/1974 Kornrumpf ..... H05B 6/062 219/626

(Continued)

*Primary Examiner* — Robert J Utama
*Assistant Examiner* — Lawrence H Samuels
(74) *Attorney, Agent, or Firm* — QuickPatents; Kevin Prince

(57) ABSTRACT

A heating device, its use and a kit for making it are described. The device comprises an induction element, an induced element, and a first elemental dielectric element located between the inductive element and the induced element. The effect of a metal alloy containing a first metal or a mixture of metals in a proportion of 90% and 99.99% by weight to the total weight and to a second metal or a second mixture of metals in a percentage between 0.01% and 10% by weight to the total weight. The first metal is an amagnetic metal, for example diamagnetic or paramagnetic or antiferromagnetic metal, or the first mixture of metals is a magnetic and/or can be understood to include non-magnetic metals. The second metal is a ferromagnetic/ferrimagnetic metal, or the second mixture of metals exclusively including ferromagnetic or ferrimagnetic metals. Alternatively, it is possible to use electrically conductive engineering plastics.

17 Claims, 11 Drawing Sheets

(56) References Cited

U.S. PATENT DOCUMENTS

| | | | | | |
|---|---|---|---|---|---|
| 3,814,888 | A * | 6/1974 | Bowers | H02M 7/5236 | 219/624 |
| 4,533,807 | A * | 8/1985 | Minamida | H05B 6/12 | 219/621 |
| 4,544,818 | A * | 10/1985 | Minamida | H05B 6/12 | 219/621 |
| 5,064,055 | A * | 11/1991 | Bessenbach | A47J 36/02 | 220/626 |
| 5,073,689 | A * | 12/1991 | Tabata | C04B 35/80 | 219/200 |
| 5,378,879 | A * | 1/1995 | Monovoukas | B29C 35/08 | 219/634 |
| 2003/0160053 | A1* | 8/2003 | Kim | A47J 36/02 | 220/573.1 |
| 2004/0229079 | A1* | 11/2004 | Groll | A47J 36/02 | 428/653 |
| 2006/0118548 | A1* | 6/2006 | Imura | A47J 36/027 | 219/634 |
| 2009/0065500 | A1* | 3/2009 | England | H01F 41/00 | 219/621 |
| 2016/0338152 | A1* | 11/2016 | Lestringant | C03C 3/083 | |
| 2018/0317702 | A1* | 11/2018 | Corrado | C22C 21/02 | |

* cited by examiner

HEATING DEVICE, ITS USE AND KIT

CROSS-REFERENCE TO RELATED APPLICATIONS

This application claims the benefit of PCT Application PCT/IB2017/054272, filed on Jul. 14, 2017, and incorporated herein by reference.

STATEMENT REGARDING FEDERALLY SPONSORED RESEARCH AND DEVELOPMENT

Not Applicable.

FIELD OF THE INVENTION

The present invention refers to a heating device comprising an induction element, a monolithic or multilayered induced element with stratigraphy having metallic and/or dielectric behavior and a dielectric element placed between them. Induction heating devices of this type can be used for heating rooms and/or objects, on which the heating device is placed or integrated or else for heating and cooking food, fluids and others, or else for heating components or machines in industrial processes.

BACKGROUND ART

It is known that by subjecting a metallic element to a magnetic field variable in space and/or time, electric currents are induced in the element itself; these electric currents are defined parasitic currents (or Eddy currents) and, in their turn, they heat the metal element by Joule effect, which cooperates with the dissipative effect reorienting the magnetic domains, known in literature as hysteresis loop which is typical and characteristic of ferromagnetic materials.

A number of practical applications exploit this phenomenon. For example, the heating of pots on induction hobs and the production of electromagnetic brakes in some types of heavy vehicles, have to be enumerated among the most known.

Not all of the materials with metallic behavior are suitable to make items of practical interest exploiting this phenomenon.

For example, for making pots for induction hobs it is necessary to use a metal having sufficiently low electric resistance for efficiently conducting the induced parasitic currents, but beyond a certain lower limit of electric resistance, sufficient dissipation of energy to heat the pot by Joule effect is not obtained.

The same drawback can also be found in other technological fields.

Therefore, over time some metals have been preferred to others, so much that de facto standards have been created in reference markets.

Referring once again to the example of the pots for induction hobs, cast iron and some ferritic steels have been preferred to aluminum, although the latter has lower specific gravity—an aspect that would allow making light and cheaper pots—and high thermal conductivity making it more suitable for cooking food.

Also in railway, automotive and industrial automation fields, iron and some steels are some of the preferred metals to make electromagnetic brakes.

In other words, other metals less performing from the point of view of physical chemical properties, but better responding to magnetic fields generated at powers compatible with civil or industrial use in the context of the phenomenon described above, have been preferred to some metals having physical chemical properties more suitable for a particular use.

In general, metals having high values of thermal conductivity also boast high electrical conductivity but sometimes excessive for obtaining an effective heat production caused by the induction. For example silver, gold and aluminum are characterized by excellent thermal and electrical conductivities, but are poorly reactive to variable magnetic fields with civil and industrial powers and/or frequencies.

Notoriously, metals can be classified depending on the attitude to magnetize in the presence of a magnetic field. Quantitatively and practically, metals are classified as ferromagnetic, diamagnetic and paramagnetic depending on the value of the relative magnetic permeability, in its turn corresponding to the ratio:

$$\mu\Gamma=\mu/\mu0, \tag{1}$$

between the absolute magnetic permeability of the metal and the magnetic permeability $\mu0$ of vacuum. The absolute magnetic permeability is defined as the ratio between the magnetic induction B and the intensity H of the magnetizing field, i.e.:

$$\mu=B/H. \tag{2}$$

The magnetic permeability of vacuum $\mu0$ is one of the fundamental physical constants; its value is expressed in Henry/meter in the International System:

$$\mu0=4\pi\times10^{-7}\ \text{H/m}. \tag{3}$$

The relative magnetic permeability is constant in diamagnetic metals ($\mu<\mu0$) and slightly lower than the unit. In paramagnetic metals the relative magnetic permeability is slightly higher than the unit and is inversely proportional to temperature. In ferromagnetic metals the relative magnetic permeability is much higher than the unit ($\mu\gg\mu0$) and varies, in addition to the temperature, also upon variation of the magnetizing field.

There are a few metals presenting ferromagnetic or ferrimagnetic properties at room temperature, such as for example iron, cobalt and nickel. Some rare earth elements are ferromagnetic at temperatures even much lower than room temperature.

The following table 1 summarizes the classification.

TABLE 1

| Metal | Relative Magnetic Permeability |
|---|---|
| Ferromagnetic | $\mu_r >> 1$ |
| Diamagnetic | $\mu_r < 1$ |
| Paramagnetic | $\mu_r > 1$ |

The difference between the values of the relative magnetic permeability of paramagnetic metals, with respect to diamagnetic metals, is minimal and often negligible for practical purposes, particularly for what concerns the induction heating.

Independently from the just summarized classification, for simplicity in the following description paramagnetic metals and diamagnetic metals will be simply defined amagnetic or non-magnetic metals, the same way as metals that in general are not appreciably interacting with magnetic fields, among which aluminum, copper, titanium, tungsten can be mentioned, for example.

As mentioned above, some amagnetic metals have excellent physical properties and particularly thermal conductivity, but are not directly used in applications providing for the heating by eddy currents, precisely because instead of these other metals are preferred such as iron, cast iron or some specific steels having more effective response to the magnetic fields. The use of amagnetic metals is only possible in combination with ferromagnetic metals, for example by assembling parts made of different metals, as described above in the example of the pots made of aluminum.

For example, aluminum (rolled) has thermal conductivity equal to 190 kcal/m° C.—i.e. at least seven times higher than a common stainless steel, and copper (electrolytic) has thermal conductivity equal to 335 kcal/m° C.—i.e. at least twelve times higher than stainless steel. Therefore in an application that provides for heating, either by induction or any other system and for which is important to have the maximum thermal conductivity, copper will be preferable to aluminum and the latter to steel.

Thus, it is desirable to be able to overcome the limits described above, also to exploit the amagnetic metals in all practical applications providing for heating caused by parasitic currents induced by magnetic fields.

Furthermore, it is desirable to make an induction heating device based on the use of such amagnetic metals.

Finally, it is desirable to make the induction heating device so that it can be integrated or combined with different elements, for example in furniture and/or building elements or elements for cooking food, in order to provide the possibility to have non-visible and/or non-intrusive heating.

SUMMARY OF THE INVENTION

Therefore it is an object of the present invention to obtain an improved heating device, or a kit for making it, preferably able to solve one or more of the above mentioned problems.

Therefore the present invention relates to a heating device comprising: an induction element, an induced element, and a first dielectric element placed between the induction element and the induced element, in case wherein the dielectric element is constituted by vacuum, or gas, particularly air. The induced element comprises, or it is constituted by, a metal alloy containing a first metal or a first mixture of metals in a percentage between 90% and 99.99% by weight to the total weight and containing a second metal or a second mixture of metals in a percentage between 0.01% and 10% by weight to the total weight. The first metal is an amagnetic metal, for example diamagnetic or paramagnetic or antiferromagnetic metal. Similarly, the first mixture of metals is amagnetic, or exclusively comprises non-magnetic metals. The second metal is a ferromagnetic or ferrimagnetic metal. Similarly the second mixture of metals is magnetic or exclusively constituted by ferromagnetic or ferrimagnetic metals. Alternatively to metals, it is possible to use materials with metallic behavior, such as for example the electrically conductive engineering plastics.

The expressions "magnetic alloy" and "amagnetic alloy" denote alloys having respectively, on the whole, a behavior assimilable to that of ferromagnetic or ferrimagnetic metals, i.e. magnetic metals, and a behavior assimilable to that of non-magnetic metals, even if alloys can contain minimal quantities of respectively non-magnetic and magnetic metals. What matters is the behavior of the alloy on the whole.

The heating device is compact and/or also flexible, and can advantageously be integrated in different devices or materials, and/or can advantageously be applied to curved surfaces, in case having variable radius.

In some embodiments, the induced element has thickness lower than, or equal to 10 cm.

Depending on the embodiment, the total thickness of the induced element is defined by a compact foil or an overlapping of more foils that can include at least one dielectric element, for example air, glue, or other.

Thanks to this characteristic it is possible keep compact the thickness of the heating device.

In some embodiments the induced element has thickness between 5 μm and 700 μm, and more preferably between 5 μm and 200 μm.

The average electro-thermal transduction efficiency of the induced amagnetic element made according to claim 1 is higher by at least 10%-15% with respect to the average electro-thermal transduction efficiency of a different induced element.

In some embodiments, the alloy can contain less than 1% by weight of one or more rare-earth elements, where the rare-earth elements are identified according to IUPAC definition, or an oxide thereof, or else MishMetal, in its turn composed of 50% cerium, 25% lanthanum and a little percentage of neodymium and praseodymium; non-metals, such as carbon, and/or semimetals, such as silicon. This allows obtaining an induced element having excellent physical and/or chemical characteristics.

In some embodiments, the content by weight of the first metal or first mixture of metals, with respect to the alloy total, is between 95% and 99.99%, and the content by weight of the second metal or second mixture of metals, with respect to the alloy total, is between 0.01% and 5%, preferably between 0.01% and 3%. This allows obtaining an induced element having excellent physical and/or chemical characteristics and optimal conversion efficiency of electric energy to thermal energy.

In some embodiments, the first metal is selected among gold, silver, copper, aluminum, platinum, titanium, boron, or the first mixture is a mixture of two or more among gold, silver, titanium, copper, aluminum, platinum, boron, and the second metal is one among nickel, iron, cobalt, and the second mixture is constituted by two or more among nickel, iron, cobalt. This allows obtaining an induced element having excellent physical and/or chemical characteristics.

In some embodiments, the titanium content in the alloy, if present, is lower than 0.5% by weight to the total weight, preferably 0.1%-0.2%; the boron content in the alloy, if present, is lower than 0.5% by weight to the total weight, preferably 0.1%-0.2%; the iron content in the alloy, if present, is lower than 3% by weight to the total weight, preferably 0.01%-3%.

Thanks to this embodiment it is possible obtaining an induced element having excellent physical and/or chemical characteristics.

In some embodiments, the induction element comprises a first conductive element of which at least part has spiral shape. This allows the induction element to be made simple and compact.

In some embodiments, the induction element comprises a second conductive element of which at least part has spiral shape. This allows the induction element to be made simple and compact. Furthermore, the presence of two or more induction elements allows advantageous positioning freedom of the same with respect to the induced element.

In some embodiments, the first conductive element comprises ends, and also the second conductive element comprises ends, and the first and second ends can be connected on the same device side. In this way it is possible to easily connect several conductive elements to a power generator.

In some embodiments, the first dielectric element has thickness between 1 μm and 10 cm.

Thanks to this embodiment, it is possible to obtain a very compact and flexible heating device, or else to place the induced element and the induction element at higher distance, by integrating them in thicker elements or products, for example building materials or the like, or else in industrial processes.

In some embodiments, the first dielectric element is wound round the induction element. This allows the induction element and the dielectric element to be implemented with an electrical wire having a sheath, or the like.

In some embodiments, the device further comprises a second dielectric element placed on the induction element at the side opposite to the first dielectric element. In this way it is possible to further electrically and/or physically insulate the device from the surrounding environment.

In some embodiments the device further comprises a third dielectric element placed on the induced element at the side opposite to the first dielectric element. This allows further electrically and/or physically insulating the device from the surrounding environment.

In some embodiments, the first dielectric element and/or the second dielectric element and/or the third dielectric element comprise/s one or more materials, for example plastic, resin, glass, vacuum, ceramic, wood, conglomerate of powdered oxides, stone. This allows the device to be integrated inside the elements, tools or personal grooming or household items, for example tiles, thus obtaining a room-heating device that is not visually invasive. Or else it is possible to make cooking tools resistant to scratches and cuts, or else handier ironing tools.

In some embodiments the induced element comprises an embossing. This allows the energy transfer from the induction element to the induced element to be increased, in case by also integrating aesthetic elements.

In some embodiments, the induced element comprises a plurality of foils. This allows the device to be made even more flexible, particularly in case wherein the foils are mobile to one another, or even not connected to one another.

In some embodiments, the foils are parallel and/or crossed, flanked and/or overlapped to one another. This allows different weaves with the foils to be made, in order to better adapt to the specific type of usage of the heating device.

Furthermore, it is possible to achieve the thicknesses for the amagnetic mixtures, suitable and functional to the above described heating system. Thus, the induced element can show a single compact foil or overlapped foils interposing with dielectric elements, such as for example air, or gluing systems, resins, etc.

In some embodiments the foils are concertina fold.

This allows higher heat generation per volume unit and/or higher structural resistance of the induced element to be obtained.

In some embodiments, at least the induced element or the induced, dielectric and induction element comprise a convex or concave surface. This allows adapting the device to curved or curvilinear surfaces, in case having variable and/or flexible radius, by way of example a tube or a tube portion.

An embodiment can further refer to a use of a device according to any one of the previous embodiments for room heating, food heating and cooking, personal heating through devices and clothes, heating and cooking in industrial processes.

Thanks to this embodiment, it is possible to obtain a room heating having a heating device that is particularly compact and easy to be integrated in the devices and objects to be heated.

In some embodiments, the induced element has undergone an anodizing process. This allows an induced element having excellent chemical-physical qualities, optimal resistance and protection to scratches and diverse environmental conditions, variability of the colors and surface structure of the induced element, to be made.

An embodiment relates to a kit for making a device according to any one of the previous embodiments, comprising: an induction element, and/or an induced element, and/or a first dielectric element to be placed between the induction element and the induced element, where the induced element can comprise an alloy of material with metallic behavior containing a first metal or a first mixture of metals in a percentage between 90% and 99.99% by weight to the total weight and containing a second metal or a second mixture of metals in a percentage between 0.01% and 10% by weight to the total weight; where the first metal can be an amagnetic metal, for example diamagnetic or paramagnetic or antiferromagnetic metal, or where the first mixture of metals is amagnetic and/or can exclusively comprise non-magnetic metals, and where the second metal can be a ferromagnetic or ferrimagnetic metal, or where the second mixture of metals can exclusively comprise ferromagnetic or ferrimagnetic metals. Alternatively to metals it is possible to use materials with metallic behavior, such as for example the electrically conductive engineering plastics. Thanks to this embodiment, it is possible to separately sell the induced element, the induction element and the dielectric element, for then joining them together when the device has to be made.

The above described advantages related to the device, its relative use and kit, can also be obtained by using non-metallic materials but showing metallic behavior, such as for example the electrically conductive engineering plastics, alternatively to metals and metal alloys.

DESCRIPTION OF THE DRAWINGS

Further characteristics and advantages of the invention will be better evident by the review of the following specification of a preferred, but not exclusive, embodiment illustrated for illustration purposes only and without limitation, with the aid of the accompanying drawings, wherein.

DETAILED DESCRIPTION OF THE PREFERRED EMBODIMENT

Figure 1:
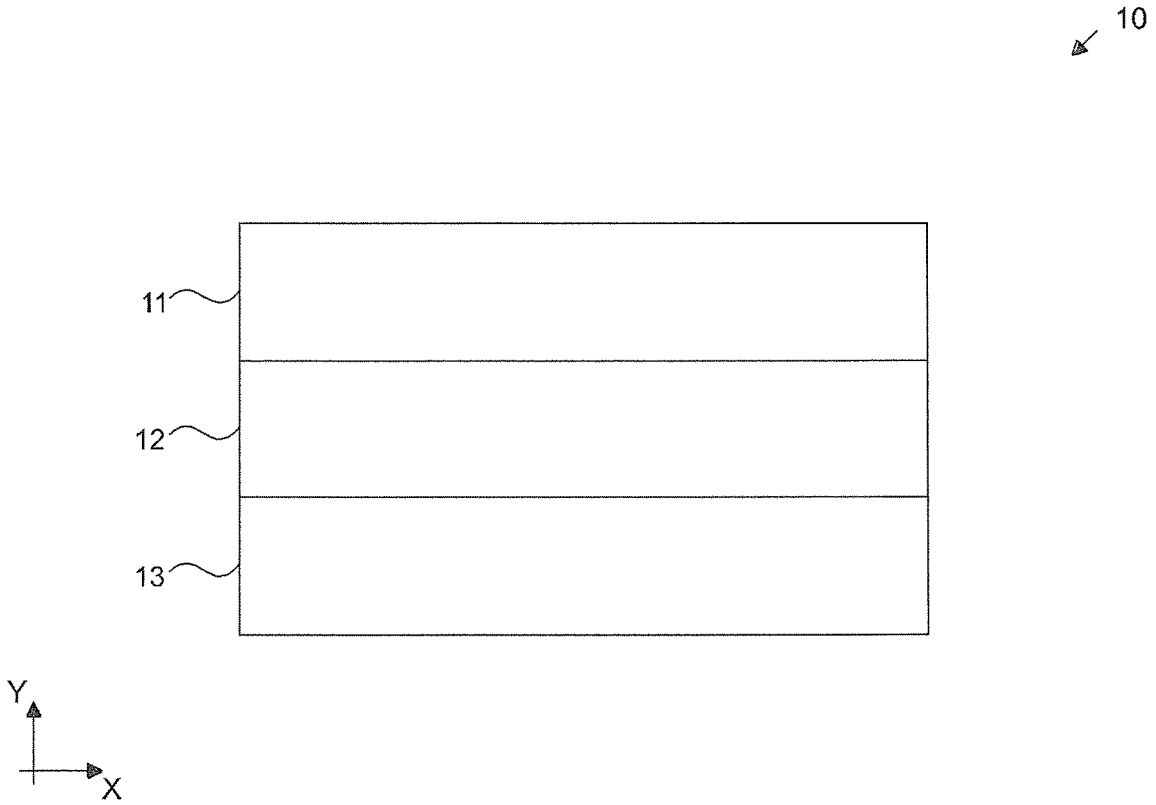
FIG. 1 schematically shows a sectional view of an induction heating device according to an embodiment of the present invention.

In an embodiment of the present invention, a first metal having a non-magnetic behavior—in that at room temperature it does not clearly interact with magnetic fields—and a second ferromagnetic metal—i.e. that interacts at room temperature with magnetic fields—are used to make an alloy of material with metallic behavior. The proportions of the two metals are those described above and in the claims.

The alloy can be obtained with different techniques, for example melting, sintering, and dispersing a powdered metal in a liquid phase.

Referring for simplicity to the melting, the alloy is solidified in billets that then are used for example in a rolling mill for obtaining a film, or induced element, having the desired thickness.

The rolling technique is well known and there is no need to describe it in detail. For example, the following movie available on the YouTube Internet platform explains how films made of food aluminum are produced in a rolling mill: https://www.youtube.com/watch?v=ISRCuYb3-kc The manufacturing can be done for example just with the rolling that is the preferred technique.

The so-manufactured film can therefore be used as induced element in an induction heating device, as it will be described herein below.

The alloy can also be obtained starting from several first metals and several second metals, as described above.

The following examples describe the phenomenon.

EXAMPLES

Example 1

Alloy constituted by silver, copper, nickel and earth elements in the percentages by weight shown in table below.

| | | |
|---|---|---|
| Diamagnetic metals | Silver 47% | Copper 49.5% |
| Ferromagnetic Metal | Nickel 3% | |
| Other metals | Rare Earth Silicide 0.5% or else MishMetal 0.5% | |
| Thickness of the film | 200 μm | |

In its turn the rare-earth silicide is composed of Si=40%-45%, rare-earth elements 8%-10% and iron for the remainder; MishMetal is typically composed of 50% cerium, 25% lanthanum and a little percentage of neodymium and praseodymium.

The film has been heated with the induction hob 11 adjusted at the power of 1000 W and reached the temperature of about 800° C. (red color) after little less than 10 seconds.

Example 2

Alloy constituted by copper, nickel and rare earth elements in the percentages by weight shown in the table below.

| | |
|---|---|
| Diamagnetic metals | Copper 89.5% |
| Ferromagnetic Metal | Nickel 10% |
| Other metals | Rare Earth Silicide 0.5% or else MishMetal 0.5% |
| Thickness of the film | 100 μm |

In its turn, the rare-earth silicide is composed by Si=40%-45%, rare-earth elements 8%-10% and iron for the remainder; MishMetal is typically composed of 50% cerium, 25% lanthanum and a little percentage of neodymium and praseodymium.

The film has been heated with the induction hob 11 adjusted at the power of 1000 W and reached the temperature of about 1100° C. (bright red color) in little less than 10 seconds.

Example 3

Alloy constituted by aluminum and iron in the percentages by weight shown in the table below.

| | |
|---|---|
| Diamagnetic metals | Aluminium 97.3% |
| Ferromagnetic Metal | Iron 2.7% |
| Thickness of the film | 100 μm |

The film has been heated with the induction hob 11 adjusted at the power of 250 W and reached the temperature of about 350° C. in little less than 10 seconds.

In some embodiments of the present invention the above described film, corresponding to the induced element, is embossed to increase the interaction with the magnetic field generated by an induction element that will be described herein below.

In an embodiment of the present invention, the film is made by an aluminum and iron alloy, with aluminum in an amount between 97% and 99.99% by weight (% wt.) and iron in an amount between 0.01% and 3% (% wt.), advantageously between 0.01% and 1.8% (% wt.). The alloy can further comprise titanium and/or boron, each in amounts not higher than 0.5%, advantageously between 0.1% and 0.2%. These metals have the purpose to carry out satisfactory refining of the alloy, thus allowing the formation of smaller and substantially spherical-shaped granules and improving its overall mechanical characteristics. Furthermore, other elements (metallic and non-metallic) can be present in traces, generally with an overall amount lower than 0.5%.

The film has thickness equal or lower than 10 cm, where the total thickness of the induced element can be represented by a compact foil or an overlapping of more foils, that can include at least one dielectric element between the foils (e.g. foil 1+air+foil 2 or else foil 3+glue+foil 4, etc.).

FIG. 1 is a schematic sectional view of a heating device 10 according to an embodiment of the present invention.

In particular, the heating device 10 can be of the induction type and comprises an induction element 11, an induced element 13, and a first dielectric element 12 placed between the induction element 11 and the induced element 13.

In some embodiments, the induction element 11 can be any element able to generate a variable magnetic field, for example a coil, a spiral, or more generally a conductive element or any device configured to be able to generate a variable magnetic field.

In some embodiments, the first dielectric element 12 is any element able to electrically insulate the induction element 11 from the induced element 13, for example also vacuum space or else an air layer.

In some embodiments the induced element is any one of the previously described films. More in general, the induced element can be any material by which it is possible to generate heat by means of electromagnetic field induction, for example ferromagnetic metals.

In some embodiments, the induced element 13 comprises a metal alloy containing a first metal or a first mixture of metals in a percentage between 90% and 99.99% by weight to the total weight and containing a second metal or a second mixture of metals in a percentage between 0.01% and 10% by weight to the total weight. As previously described, the first metal is an amagnetic metal, for example diamagnetic or paramagnetic or antiferromagnetic metal, or the first mixture of metals is amagnetic (on the whole) or exclusively comprises non-magnetic metals. Furthermore, still as previously described, the second metal is a ferromagnetic or ferrimagnetic metal, or the second mixture of metals is magnetic on the whole or exclusively comprises ferromagnetic or ferrimagnetic metals.

This embodiment allows making an induction heating device having an advantageously compact shape and excellent operation characteristics.

It is understood that by the word "metals" can also be meant any material having metallic behavior, as well as, by way of example, the electrically conductive engineering plastics.

In some embodiments, the induced element 13 has thickness lower or equal to 10 cm, as previously described. Alternatively, in other preferred embodiments, the induced element 13 has thickness between 5 μm and 700 μm, and more preferably between 5 um and 200 μm. Thanks to these embodiments, it is possible to make a particularly compact induction heating device 10. As it will be described herein below, this allows in case to make a flexible induction heating device 10 that can be applied to curved surfaces, even flexible or with varying curvature. In other embodiments, as it will be described herein below, such a thickness of the induced element 13 allows an easy integration with different building or food or furniture materials or materials for the person, without having negative impact on their thickness.

Figure 2A:
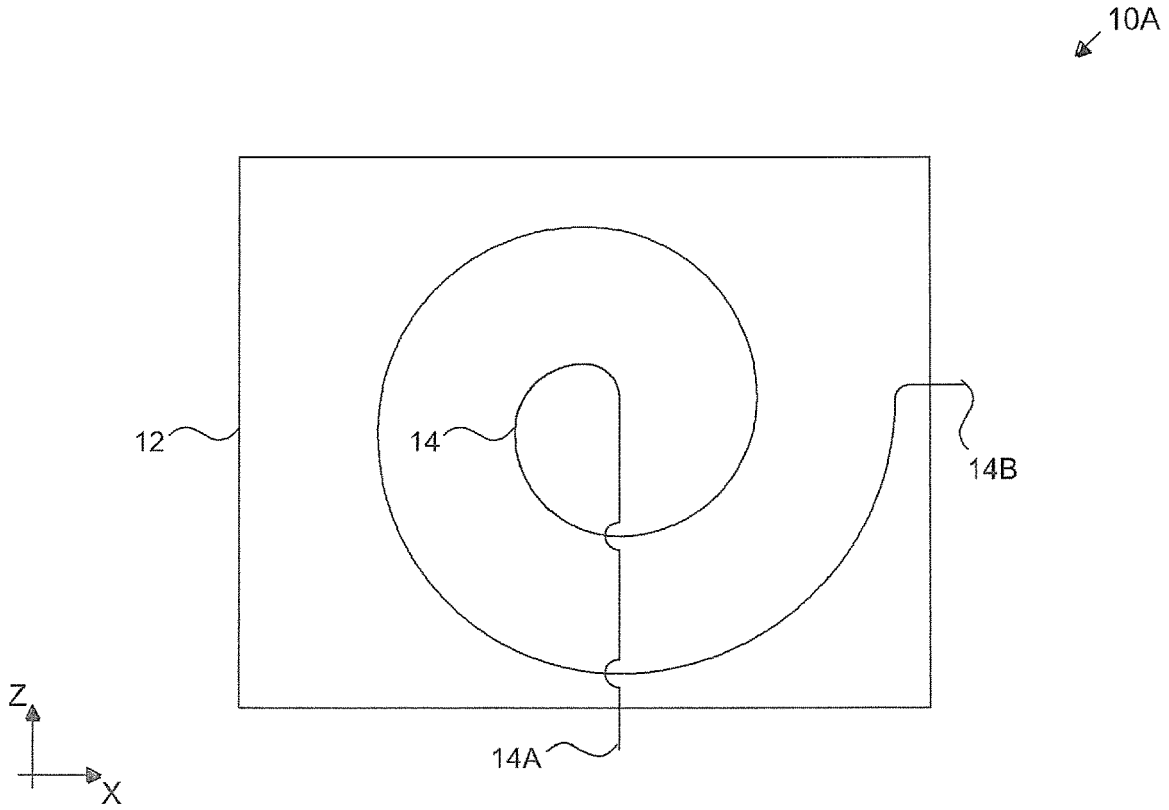
FIGS. 2A-2G schematically show top views of different induction elements according to different embodiments of the present invention.

FIG. 2A schematically depicts a top view of an induction heating device 10A. In particular, in the figure a specific embodiment of the induction element 11 is visible. As it is visible in the figure, the induction element 11 comprises a first conductive element 14 of which at least part has spiral or equivalent shape. The conductive element 14 can be any element able to conduct electricity, for example an electrical wire, having solid cross-section or hollow cross-section, an electric deposited track of a PCB, metallic lines deposited and/or printed on the dielectric element 12, in case multi-wire, etc. Additionally or alternatively, as it will be described herein below, the conductive element 14 can be covered with resin, plastics, or any type of dielectric sheath in addition to, or replacing, the dielectric element 12.

In some embodiments, the conductive element 14 could comprise a plurality of conductive elements similar or different to/from one another.

In the specific embodiment depicted in FIG. 2A, the conductive element 14 is wound with spiral shape having two ends 14A and 14B. The spiral has no specific geometrical configuration. Different types of spirals could be implemented and generally the term spiral has to be understood as a shape wound round a central determined point, progressively approaching or moving away, depending on how the curve is run. In particular, as it will be depicted herein below, also spirals having triangular, square development, or more generally a development at least partially rectilinear and not completely curvilinear, can be implemented.

In some specific embodiments of the present invention, the diameter of the spiral or equivalent diameter of the plate measures from 1 mm to 1 m, more preferably from 3 cm to 30 cm. In some specific embodiments of the present invention, the conductive element 14 comprises one or more conductive materials selected, for example, in the group comprising copper, tungsten, brass, aluminum, iron, and the alloys comprising the same.

In the specific embodiment depicted in FIG. 2A, the two ends 14A and 14B of the spiral terminate on two different sides of the induction heating element 10A. However, the present invention is not limited to this case and the two ends 14A and 14B can terminate on any side of the induction heating element independently from one another. For example, as depicted in FIG. 2B, the two ends 14A and 14B can terminate on the same side of the induction heating element 10B, so that to advantageously allow a simple electrical connection of the two ends to a generator or more generally a source of electrical power.

Figure 2B:
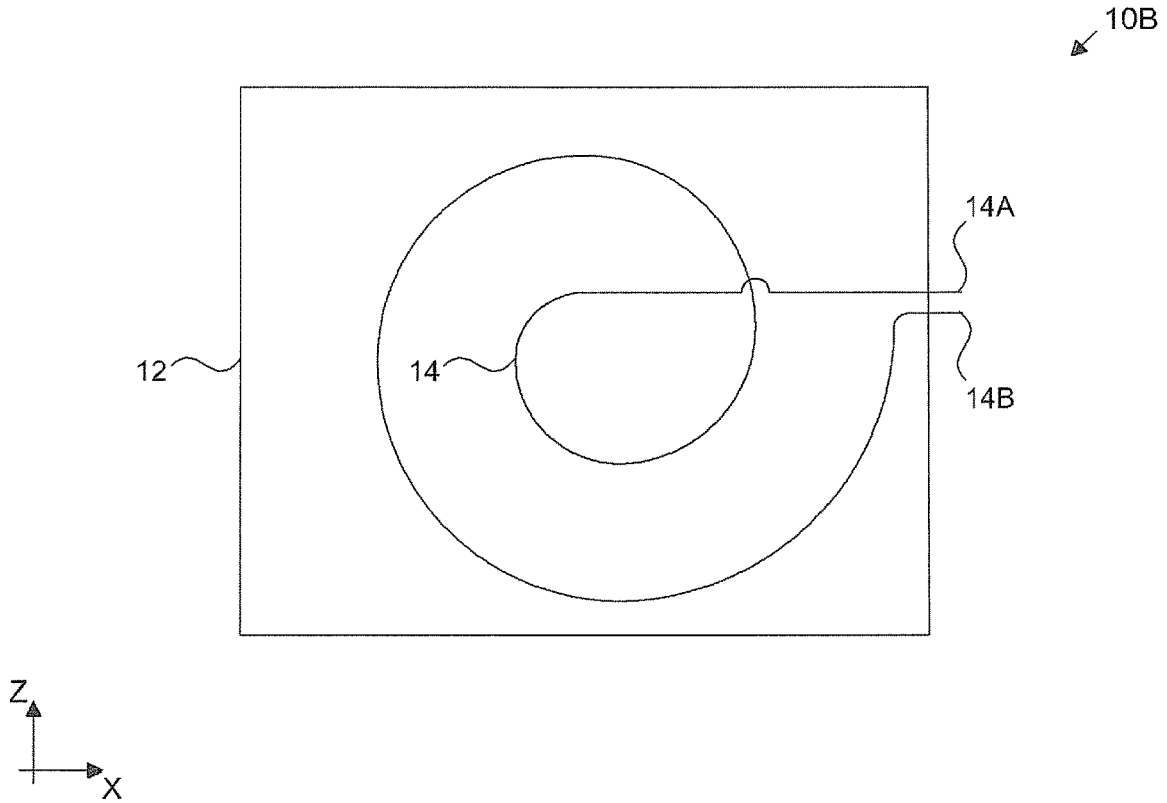
Figure 2C:
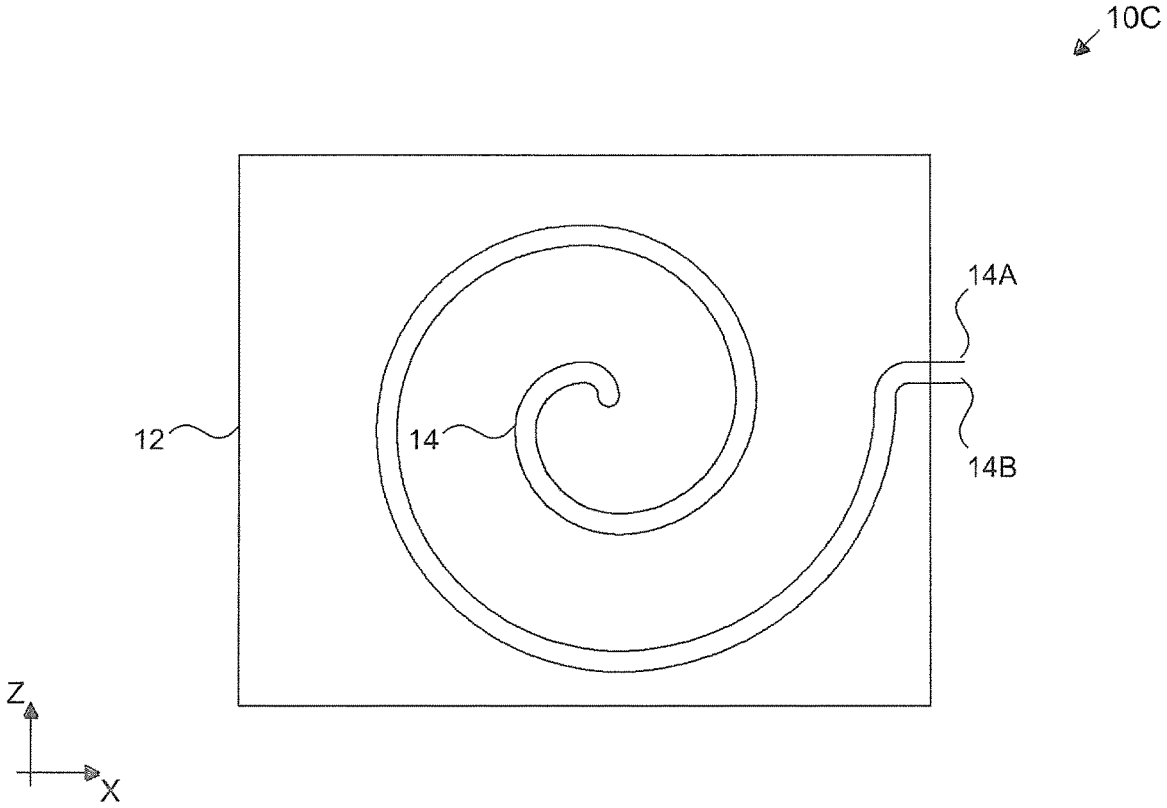

In FIGS. 2A and 2B, the spiral shape of the conductive element 14 is made by a single winding of the conductive element 14. However, the present invention is not limited to this specific embodiment and, as for example depicted in FIG. 2C, also a double winding of the conductive element 14 is possible.

Figure 2D:
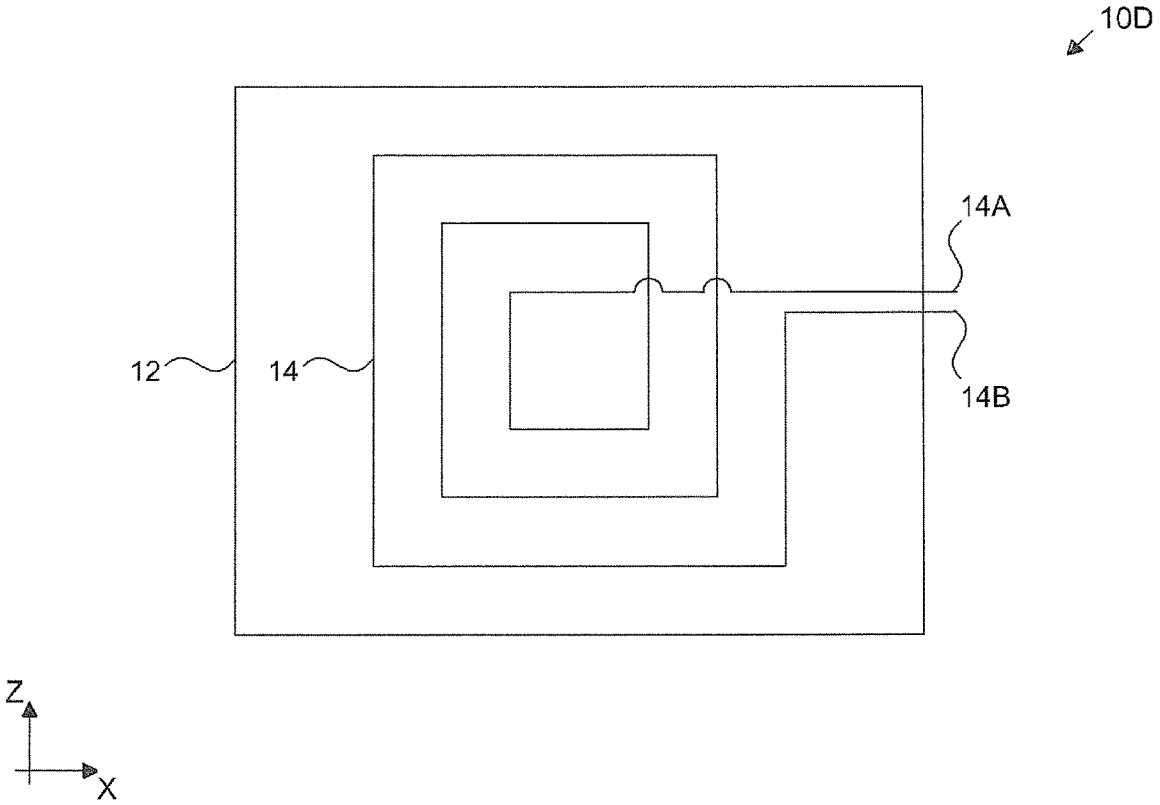
Figure 2E:
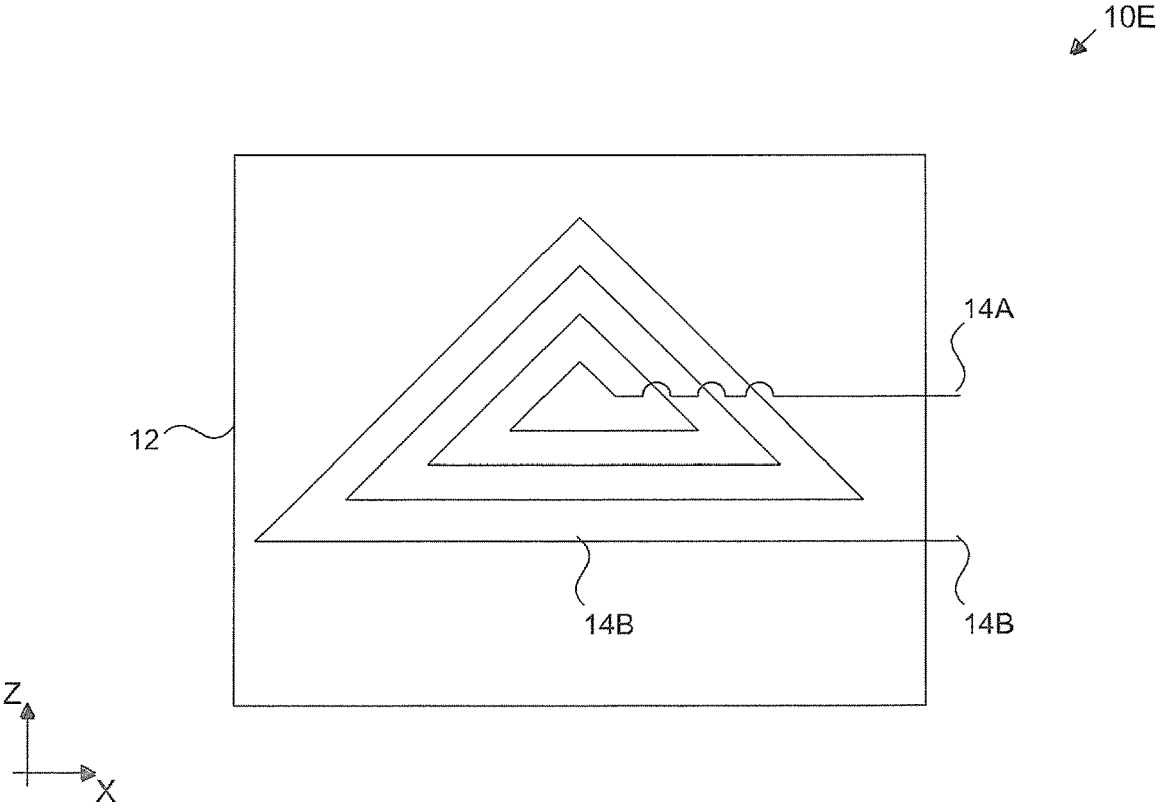

FIGS. 2D and 2E schematically depict two embodiments in which the spiral of the conductive element 14 has polygonal development, respectively square in FIG. 2D and triangular in FIG. 2E. In general, each curvilinear or rectilinear development of the spiral having single or double winding on the same side or on the two different sides of the induced element covered with dielectric sheath or shielded, is possible.

Figure 2F:
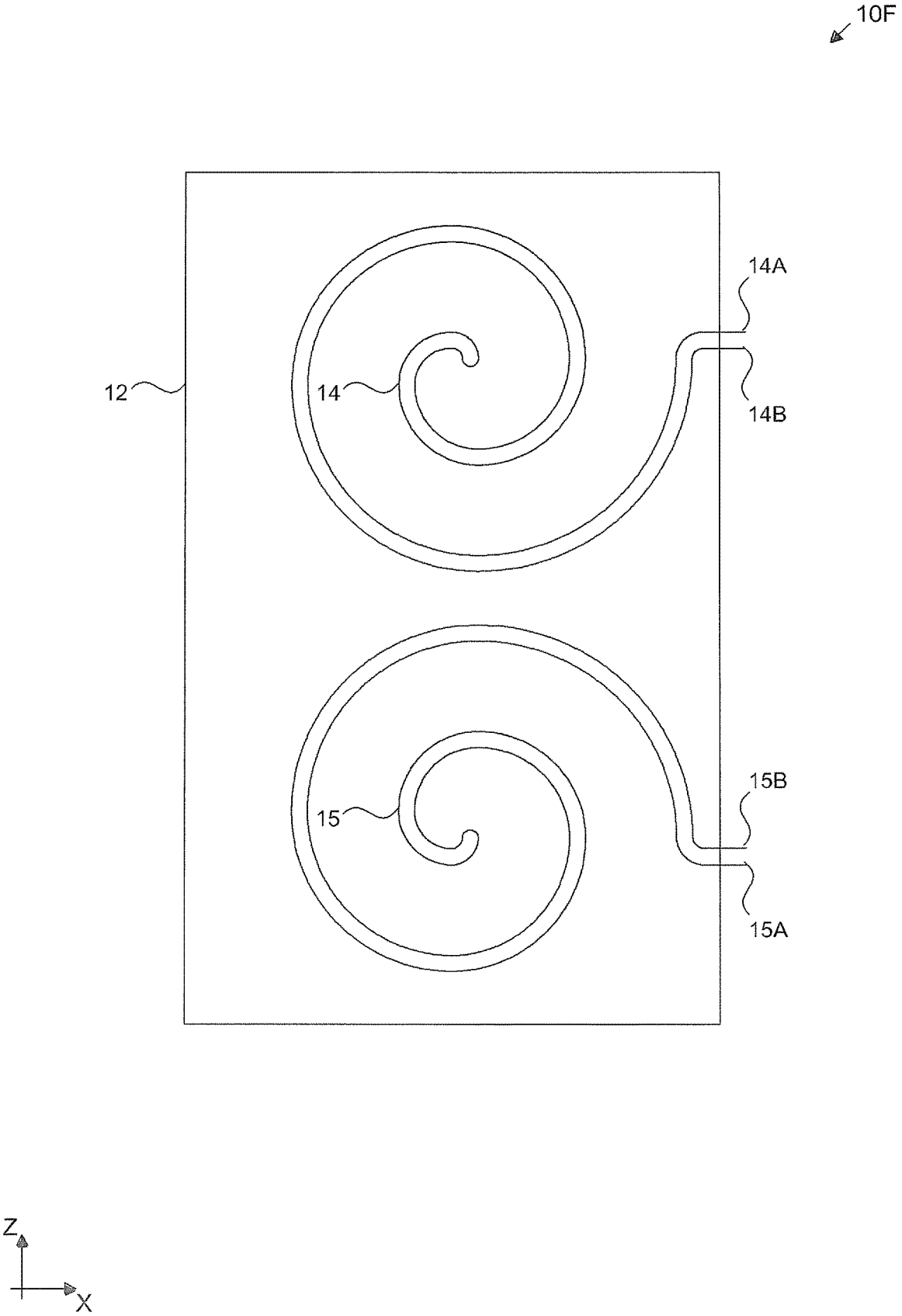

In the embodiment depicted in FIG. 2F, there are two conductive elements 14 and 15.

The first conductive element 14 comprises the ends 14A, 14B, and the second conductive element 15 comprises the ends 15A, 15B. Also in embodiments with more than one conductive element 14, 15, the position of the ends can be freely configured. In the specific case in figure, the ends 14A, 4B and the ends 15A, 5B can be connected on the same device side, which advantageously simplifies the connection to a generator. Although the conductive elements 14, 15 in the two spirals of FIG. 2F are depicted as wound in opposite directions, particularly counter-clockwise for the conductive element 14 and clockwise for the conductive element 15, the present invention is not limited to this configuration and the conductive elements 14, 15 could have in case the same winding direction in other embodiments.

Figure 2G:
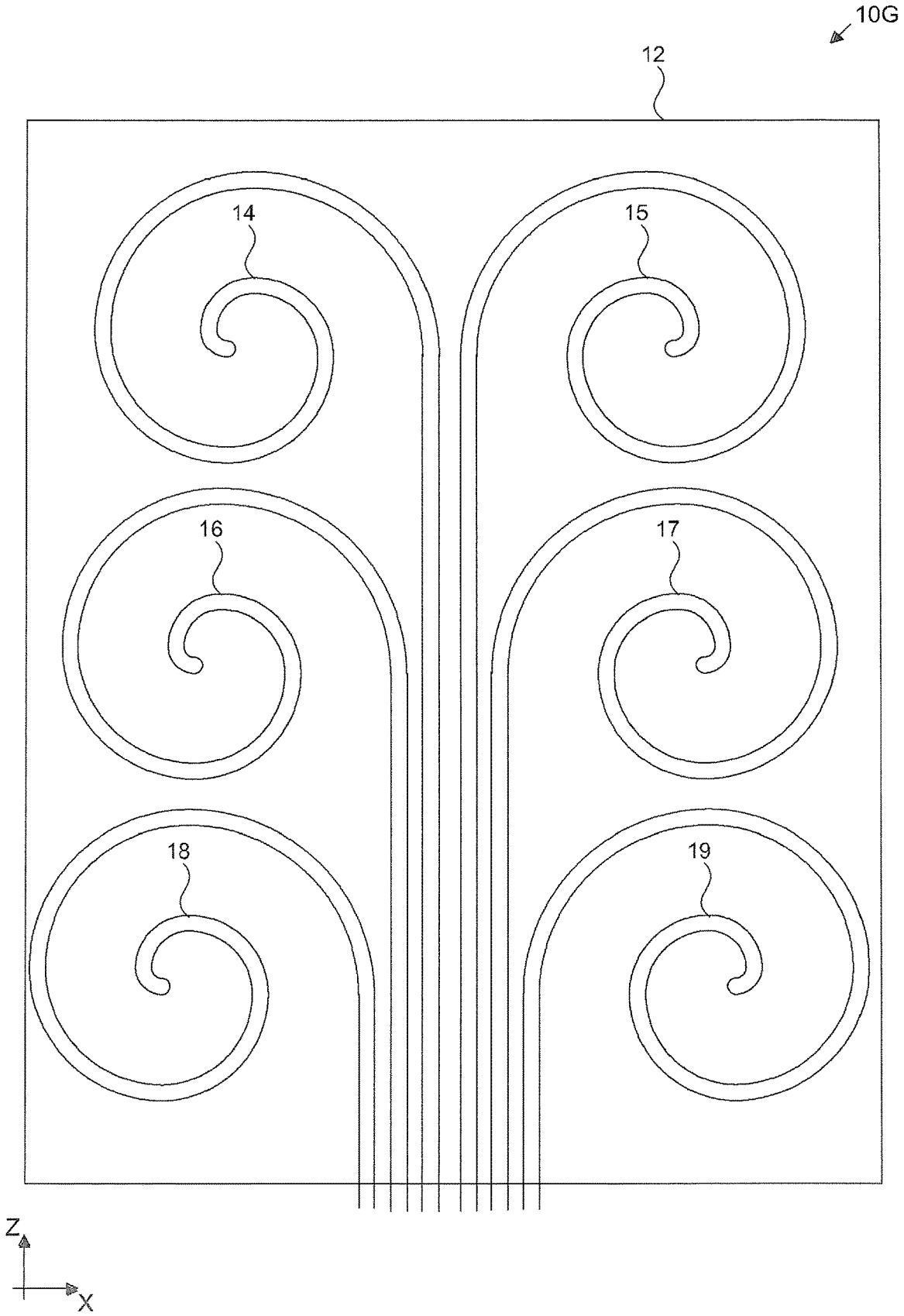

Furthermore, the number of conductive elements is not limited to one or two but can also be any number. For example, as depicted in FIG. 2G, an induction heating device 10G comprises six conductive elements 14-19. In addition, despite the type of spiral of the plurality of conductive elements 14-19 is the same, the present invention is not limited to this embodiment and different types of spirals, in case also having different sizes, could be implemented in the same induction heating device.

In some embodiments in case of unilateral assemblies, i.e. with the induction on one side only of the induction element 11 in the induced element 13, it is possible to provide for the addition of magnetic fields generated by magnets or magnetic paints on the surface of the induction element, preferably on the side of the induction element 11 not facing towards the induced element 13.

In some embodiments of the invention, the dielectric element 12 has thickness from 1 μm to 10 cm. In particular, in cases wherein the dielectric element 12 have very thin thickness, it is possible to obtain an induction heating device having restrained thickness allowing to have a flexible induction heating device and thus applicable to curved surfaces, also in case of variable curvature. On the contrary, when the thickness of the dielectric element 12 is higher, one or more materials can be used as dielectric elements for example plastic, resin, glass, ceramic, wood, conglomerate of powdered oxides, stone. Thus, in this case, it is possible to obtain an induction heating device integrated with the above mentioned materials and thus able to be easily integrated in the environment without having the need of additional heating elements, such as for example radiators. Furthermore, the device can be easily integrated in objects, tools and devices, household and personal grooming items, structures, etc.

Additionally, or alternatively, in some embodiments the first dielectric element 12 is wound round the induction element 11. This can be the case, for example, of an insulating sheath wound round a conductive wire.

Figure 3:
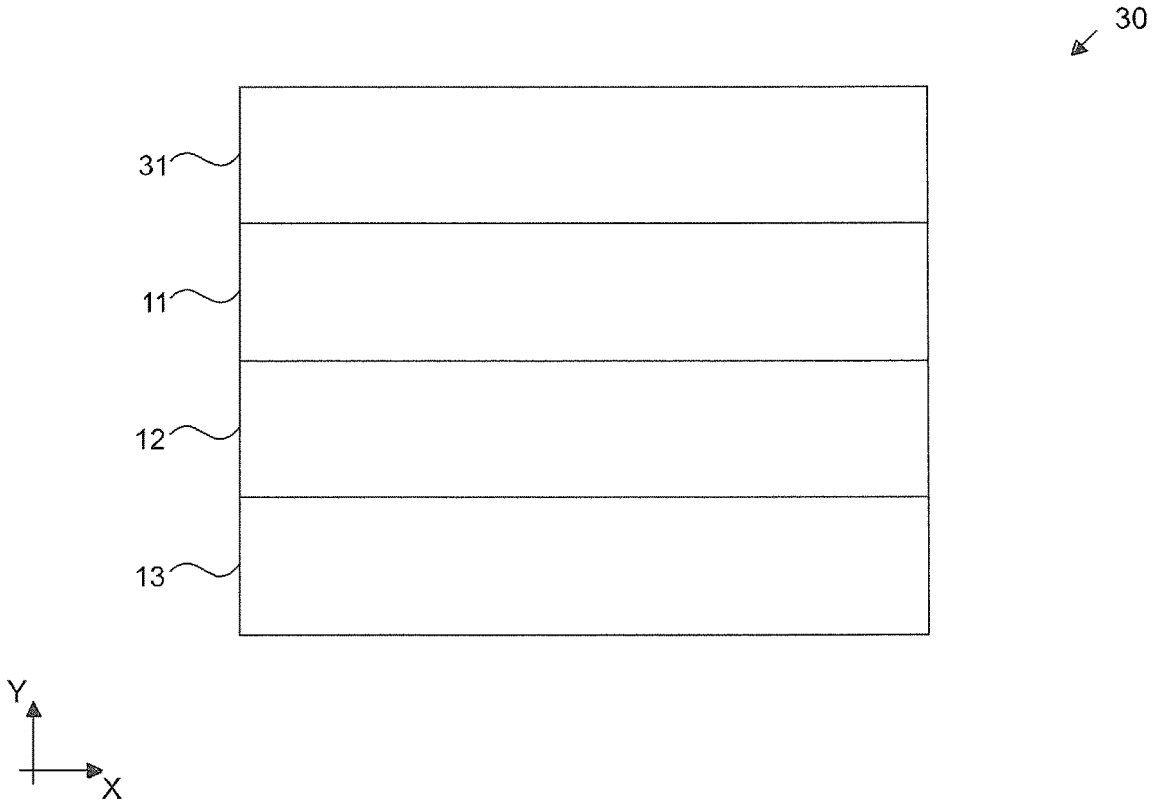
FIG. 3 schematically shows a sectional view of an induction heating device according to an embodiment of the present invention.

FIG. 3 schematically depicts a sectional view of an induction heating device 30 according to an embodiment of the present invention. In particular, the device 30 differs from the device 10 because of the presence of a second, flexible or rigid, dielectric element 31 placed on the induction element 11 at the side opposite to the first dielectric element 12.

Figure 4:
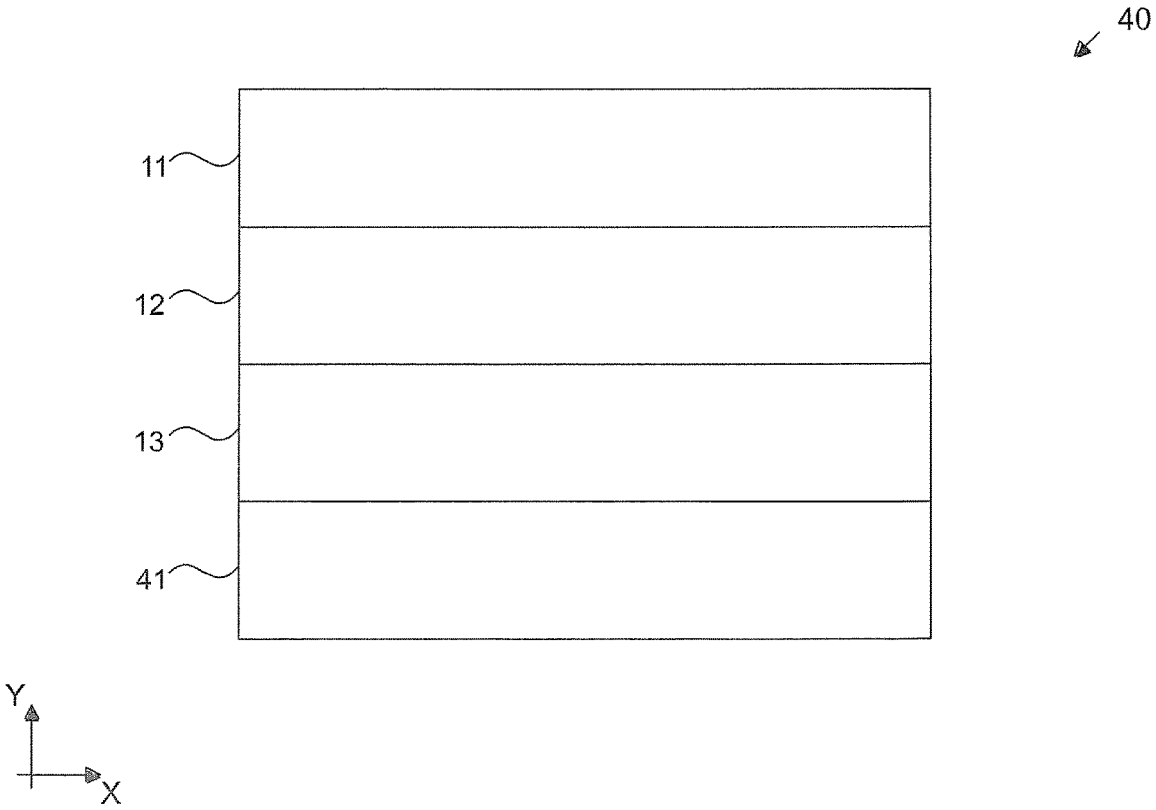
FIG. 4 schematically shows a sectional view of an induction heating device according to an embodiment of the present invention.

FIG. 4 schematically depicts a sectional view of an induction heating device 40 according to an embodiment of the present invention. In particular, the device 40 differs from the device 10 because of the presence of a third, flexible or rigid, dielectric element 41 placed on the induced element 13 at the side opposite to the first dielectric element 12.

The considerations previously set forth for the dielectric element 12 can also be applied to one or more of the flexible or rigid dielectric elements 31 and 41. Furthermore, the embodiments of FIG. 3 and FIG. 4 can be combined one another, to obtain an induction heating device comprising both the dielectric element 31 and the dielectric element 41.

EXAMPLES

Example 4

An induction heating element with three layers, comprising an induction element 11 having thickness from 3 μm to 2 cm, a dielectric layer having thickness from 1 μm to 10 cm, and an induced element 13 having thickness equal or lower than 10 cm, more preferably between 10 and 700 μm.

Example 5

An induction heating element with five layers, comprising a dielectric element 31 having thickness from 5 μm to 20 cm, preferably from 5 μm to 1 cm, an induction element 11 having thickness from 3 μm to 2 cm, a dielectric layer 12 having thickness from 1 μm to 10 cm, an induced element 13 having thickness equal or lower than 10 cm, more preferably between 10 and 700 μm, and a dielectric element 41 having thickness from 1 μm to 20 cm.

Example 6

An induction heating element comprising:

- a glass sheet, preferably having thickness of 4 mm, with dimensions from 32×36 cm, as dielectric element 41;
- a glue layer having thickness of 10 μm;
- a foil made of 97% aluminum and 2.66% iron and the remainder 0.34% amagnetic metals in traces), preferably having thickness of 10 μm, as induced element 13;
- a glue layer having thickness of 10 μm;
- a glass sheet, preferably having thickness of 4 mm, with dimensions from 32×36 cm, as dielectric element 12;
- a resin layer having thickness of 20 μm; a metallic spiral having diameter of 25 cm made with copper wire having diameter of 1.5 mm, as induction element 11, covered with a dielectric sheath having thickness of 200 μm;
- a resin layer having thickness of 20 μm; a glass sheet, preferably having thickness of 4 mm, with dimensions from 32×36 cm, as dielectric element 12;
- a glue layer having thickness of 10 μm; a foil made of 97% aluminum and 3% iron, preferably having thickness of 10 μm, as induced element 13;
- a glue layer having thickness of 10 μm; a glass sheet, preferably having thickness of 4 mm, with dimensions from 32×36 cm, as dielectric element 31.

Thus, the total thickness of the heating element is about 25 mm. The thermography detected fields heated up to 126° on the outermost surface, in about 25 minutes, with a conversion efficiency of the electric energy to thermal energy higher than 92%.

Example 7

An induction heating element comprising:

- a glass sheet, preferably having thickness of 4 mm, with dimensions from 45×27 cm, as dielectric element 41;
- a glue layer having thickness of 10 μm; a foil made of about 98.0% aluminum and about 1.54% iron and the remainder 0.56% amagnetic metals in traces), preferably having thickness of 10 μm, as induced element 13;
- a glue layer having thickness of 10 μm; a rectangular metallic spiral with dimensions 40×20 cm made with aluminum multi-wire having diameter of 1.8 mm, as induction element 11, each wire being covered with a dielectric sheath having thickness lower than 1 μm.

Thus, the total thickness of the heating element is about 6 mm. The thermography detects fields heated up to 250° C. on the outermost surface.

3 steaks having thickness of 2 cm and surface of 50 cm2 have been cooked with a power of 600 watt for 10 minutes (total consumption of 100 watt*h that, with an average Italian national cost of 0.20 euro/kWh correspond to 2 euro cents) (time and consumption have been compared with a system of the same size having a grill and heat resistance with power equal to 800 watts, that had consumptions higher by 30% for 10 minutes and a lower cooking of the meat).

Example 8

Rectangular plate having dimensions 195 mm by 105 mm, composed of the following planes:

- insulating element having non-inductive magnetic shield with thickness of 0.2 mm;
- induction element composed of a flat coil composed of 12 windings starting from the external perimeter by using an enameled monofilament conductive element made of copper having conductive section of 1 mm;

dielectric insulating element made of Vetronite having thickness of 4 mm;

amagnetic inductive foil composed of two foils of about 6 μm made of a so-composed alloy:

| | |
|---|---|
| Diamagnetic metals | Aluminium 98% |
| Ferromagnetic Metal | Iron 1.2% |
| Other amagnetic metals in traces | 0.8% |

The foils are spaced by a carbon layer of 0.5 mm. With a power of 1000 watt, they have reached the temperature of 150° C. in less than 12 seconds.

Example 9

Device composed of:

insulating element having non-inductive magnetic shield with thickness of 0.2 mm;

induction element composed of a flat coil with diameter of 10 cm composed of 10 windings starting from the external perimeter by using an enameled monofilament conductive element made of copper having conductive section of 1 millimeter;

dielectric insulating element having thickness of 4 mm;

amagnetic inductive foil having square shape and dimensions 50 mm by 50 mm, by 100 μm thickness, composed of:

| | | |
|---|---|---|
| Main diamagnetic metal | Copper 64% | Zinc 35.25% |
| Ferromagnetic Metal | Iron 0.1% | Nickel 0.3% |
| Other amagnetic metals in traces | 0.35% | |

With a power of 65 watt, the device reached the temperature of about 102° C. in about 65 seconds.

Further Experimental Tests

A) Tests with Simple Induced Element

Further 50 samples composed as per the table reported below (label: MF=ferromagnetic mixture, MA=main amagnetic mixtures, AA=other amagnetic metals; SP=thickness; rem.=remainder of the composition) have been analyzed.

| SAMPLES | SP | MF | MA | AA |
|---|---|---|---|---|
| Sample 101 | 5 mm | Fe 0.1% | Cu 99.8% | rem. |
| Sample 102 | 100 μm | Fe 0.1% | Cu 99.8% | rem. |
| Sample 103 | 50 μm | Fe 0.1% | Cu 99.8% | rem. |
| Sample 104 | 250 μm | Fe 0.1% | Cu 99.8% | rem. |
| Sample 105 | 520 μm | Fe 0.1% | Cu 99.8% | rem. |
| Sample 106 | 1 mm | Fe 0.1% | Cu 99.8% | rem. |
| Sample 107 | 200 μm | Fe 0.1% | Cu 99.8% | rem. |
| Sample 108 | 1.3 mm | Fe 0.1% | Cu 99.8% | rem. |
| Sample 109 | 5 mm | Fe 2% | Cu 97.9% | rem. |
| Sample 110 | 2.1 mm | Fe 2% | Cu 97.9% | rem. |

-continued

| SAMPLES | SP | MF | MA | AA |
|---|---|---|---|---|
| Sample 111 | 1 mm | Fe 2% | Cu 97.9% | rem. |
| Sample 112 | 500 μm | Fe 2% | Cu 97.9% | rem. |
| Sample 113 | 200 μm | Fe 2% | Cu 97.9% | rem. |
| Sample 114 | 100 μm | Fe 2% | Cu 97.9% | rem. |
| Sample 115 | 60 μm | Fe 2% | Cu 97.9% | rem. |
| Sample 116 | 40 μm | Fe 2% | Cu 97.9% | rem. |
| Sample 117 | 1.2 mm | Fe 0.02% | Cu 68.73% Zn 36.25% | rem. |
| Sample 118 | 260 μm | Fe 0.02% | Cu 68.73% Zn 36.25% | rem. |
| Sample 119 | 110 μm | Fe 0.02% | Cu 68.73% Zn 36.25% | rem. |
| Sample 120 | 70 μm | Fe 0.02% | Cu 68.73% Zn 36.25% | rem. |
| Sample 121 | 50 μm | Fe 0.02% | Cu 68.73% Zn 36.25% | rem. |
| Sample 122 | 37 μm | Fe 0.02% | Cu 68.73% Zn 36.25% | rem. |
| Sample 123 | 100 μm | Fe 0.45% | Al 99.07% | rem. |
| Sample 124 | 0.9 mm | Fe 0.1% | Ag 99.8% | rem. |
| Sample 125 | 500 μm | Fe 0.1% | Ag 99.8% | rem. |
| Sample 126 | 250 μm | Fe 0.1% | Ag 99.8% | rem. |
| Sample 127 | 100 μm | Fe 0.1% | Ag 99.8% | rem. |
| Sample 128 | 38 μm | Fe 0.1% | Ag 99.8% | rem. |
| Sample 129 | 55 μm | Fe 2% | Ag 97.9% | rem. |
| Sample 130 | 6.3 μm | Fe 1.2% | Al 98.3% | rem. |
| Sample 131 | 6.3 μm | Fe 1.26% | Al 98.3% | rem. |
| Sample 132 | 10 μm | Fe 2.68% | Al 95% | rem. |
| Sample 133 | 10 μm | Fe 1.31% | Al 98% | rem. |
| Sample 134 | 100 μm | Fe 0.88% | Al 99% | rem. |
| Sample 135 | 100 μm | Fe 1.0% | Al 98.9% | rem. |
| Sample 136 | 100 μm | Fe 0.82% | Al 99.1% | rem. |
| Sample 137 | 200 μm | Fe 0.23% | Cu 99.62% | rem. |
| Sample 138 | 1.25 mm | Fe 1.35% | Al 98.3% | rem. |
| Sample 139 | 105 μm | Fe 1.54% | Al 97.84% | rem. |
| Sample 140 | 5 mm | Fe 0.52% | Al 99.8% | rem. |
| Sample 141 | 1 mm | Fe 1.41% | Al 98.2% | rem. |
| Sample 142 | 200 μm | Fe 0.1% | Cu 70% Zn 29.80% | rem. |
| Sample 143 | 1.5 mm | Fe 2.72% | Al 93.08% Si 4.06% | rem. |
| Sample 144 | 840 μm | Fe 0.617% | Cu 90.54% Al 2.22% Si 5.54% | rem. |
| Sample 145 | 13.6 mm | Fe 1.2% Ni 1.41% | Al 92.22% Cu 3.08% | rem. |
| Sample 146 | 280 μm | Fe 2% | Al 85.75% Cu 0.314% Mn 2.17% Si 7.41% | rem. |
| Sample 147 | 300 μm | Fe 0.02% | Cu 62.80% Zn 37.16% | rem. |
| Sample 148 | 2 mm | Fe 1.52% Ni 8.28% | Cu 89.2% | rem. |

-continued

| SAMPLES | SP | MF | MA | AA |
|---|---|---|---|---|
| Sample 149 | 0.8 mm | Fe 0.02% | Ti 99.97% | rem. |

Each sample has square shape with side dimensions of 5 cm (surface of 25 $cm^2$).

Each sample has been subjected to the action of an electromagnetic field generated by a flat circular spiral having an external diameter of 73 mm and an internal diameter of 6 mm, by using multi-conductive copper wire of 1.5 mm without external sheath.

Each sample has been placed in parallel to the plane where the induction spiral lies by aligning the respective centers, separating the spiral and the sample with a fiberglass plate having dimensions 100×100×2.5 mm.

The electromagnetic field is obtained by powering the spiral with a sinusoid generated by a ZVS oscillator of Royer type, having power modulated at PWM at 24V and 20% duty cycle.

Duration of the test: 30 seconds per each sample.

Results of the Experimental Tests

A) Tests with Simple Induced Element

| SAMPLES | Average power (Watt) | Initial T (° C.) | Final T (° C.) | Watt h |
|---|---|---|---|---|
| Sample 101 | 18.0 | 31.1 | 32.7 | 0.15 |
| Sample 102 | 37.4 | 31.2 | 93.2 | 0.31 |
| Sample 103 | 38.1 | 48.7 | 117.8 | 0.32 |
| Sample 104 | 25.2 | 42.8 | 70.9 | 0.21 |
| Sample 105 | 20.1 | 42.9 | 55.1 | 0.17 |
| Sample 106 | 18.2 | 35.1 | 42.1 | 0.15 |
| Sample 107 | 26.1 | 38.1 | 65.0 | 0.22 |
| Sample 108 | 17.7 | 36.7 | 45.0 | 0.15 |
| Sample 109 | 19.1 | 31.7 | 34.1 | 0.16 |
| Sample 110 | 19.8 | 30.8 | 30.8 | 0.16 |
| Sample 111 | 19.6 | 32.3 | 44.1 | 0.16 |
| Sample 112 | 23.3 | 35.0 | 62.3 | 0.19 |
| Sample 113 | 33.3 | 43.1 | 89.1 | 0.28 |
| Sample 114 | 37.7 | 51.9 | 132.6 | 0.31 |
| Sample 115 | 35.4 | 73.0 | 152.9 | 0.29 |
| Sample 116 | 30.0 | 79.9 | 122.4 | 0.25 |
| Sample 117 | 19.6 | 43.3 | 54.0 | 0.16 |
| Sample 118 | 34.2 | 45.7 | 85.9 | 0.29 |
| Sample 119 | 38.6 | 59.0 | 121.1 | 0.32 |
| Sample 120 | 36.2 | 66.9 | 142.3 | 0.30 |
| Sample 121 | 33.4 | 64.0 | 132.0 | 0.28 |
| Sample 122 | 28.1 | 65.6 | 106.4 | 0.23 |
| Sample 123 | 27.4 | 47.0 | 106.7 | 0.23 |
| Sample 124 | 18.5 | 37.0 | 49.3 | 0.15 |
| Sample 125 | 19.2 | 37.1 | 55.7 | 0.16 |
| Sample 126 | 25.1 | 40.8 | 70.7 | 0.21 |
| Sample 127 | 31.7 | 56.2 | 124.0 | 0.26 |
| Sample 128 | 34.9 | 59.7 | 142.5 | 0.29 |
| Sample 129 | 33.3 | 68.6 | 171.6 | 0.28 |
| Sample 130 | 23.2 | 31.6 | 67.8 | 0.19 |
| Sample 131 | 23.1 | 39.7 | 103.0 | 0.19 |
| Sample 132 | 23.8 | 42.6 | 69.5 | 0.20 |
| Sample 133 | 24.3 | 45.2 | 104.1 | 0.20 |
| Sample 134 | 43.9 | 58.0 | 152.2 | 0.37 |
| Sample 135 | 50.7 | 49.0 | 134.6 | 0.42 |
| Sample 136 | 43.4 | 51.9 | 119.5 | 0.36 |
| Sample 137 | 25.0 | 40.3 | 62.0 | 0.21 |
| Sample 138 | 20.6 | 33.9 | 43.5 | 0.17 |
| Sample 139 | 26.7 | 36.9 | 72.0 | 0.22 |
| Sample 140 | 24.5 | 31.3 | 33.0 | 0.20 |
| Sample 141 | 19.0 | 32.1 | 39.5 | 0.15 |
| Sample 142 | 45.4 | 33.2 | 47.3 | 0.38 |
| Sample 143 | 23.4 | 31.4 | 34.1 | 0.20 |
| Sample 144 | 19.7 | 31.2 | 35.0 | 0.16 |
| Sample 145 | 33.3 | 30.6 | 32.8 | 0.28 |
| Sample 146 | 34.1 | 34.0 | 83.2 | 0.28 |
| Sample 147 | 31.9 | 41.5 | 72.7 | 0.27 |
| Sample 148 | 24.3 | 34.4 | 43.1 | 0.20 |
| Sample 149 | 41.8 | 32.6 | 79.7 | 0.35 |

B) Tests with Coupled Induced Element

The experimental set-up of the tests with simple induced element has been maintained and more induced elements have been coupled as per the following table

| SAMPLES | Description of the coupled element |
|---|---|
| Sample 209 | Sample 149 + air 1-2 μm + sample 123 coupled element |
| Sample 207 | Sample 149 + air 1-2 μm + sample 119 coupled element |
| Sample 203 | Sample 149 + air 1-2 μm + sample 116 coupled element |
| Sample 210 | Sample 127 + air 1-2 μm + sample 119 coupled element |
| Sample 206 | Sample 127 + air 1-2 μm + sample 116 coupled element |
| Sample 211 | Sample 123 + air 1-2 μm + sample 149 coupled element |

-continued

| SAMPLES | Description of the coupled element |
|---|---|
| Sample 204 | Sample 123 + air 1-2 μm + sample 103 coupled element |
| Sample 212 | Sample 119 + air 1-2 μm + sample 127 coupled element |
| Sample 205 | Sample 119 + air 1-2 μm + sample 149 coupled element |
| Sample 201 | Sample 116 + air 1-2 μm + sample 149 coupled element |
| Sample 208 | Sample 103 + air 1-2 μm + sample 127 coupled element |
| Sample 202 | Sample 103 + air 1-2 μm + sample 123 coupled element |

Herein below are the results of the experimental tests with coupled induced element:

| SAMPLES | Average power (watt) | Initial T (° C.) | Final T (° C.) | Watt h |
|---|---|---|---|---|
| Sample 209 | 27.7 | 40.0 | 58.4 | 0.23 |
| Sample 207 | 35.8 | 36.0 | 60.2 | 0.30 |
| Sample 203 | 38.9 | 33.6 | 72.5 | 0.32 |
| Sample 210 | 22.5 | 40.0 | 51.8 | 0.19 |
| Sample 206 | 22.1 | 36.2 | 46.7 | 0.18 |
| Sample 211 | 31.6 | 37.8 | 56.4 | 0.26 |
| Sample 204 | 27.2 | 40.8 | 53.3 | 0.23 |
| Sample 212 | 25.6 | 40.4 | 42.4 | 0.21 |
| Sample 205 | 40.6 | 38.0 | 77.6 | 0.34 |
| Sample 201 | 41.2 | 32.2 | 72.6 | 0.34 |
| Sample 208 | 21.4 | 36.9 | 49.2 | 0.18 |
| Sample 202 | 26.5 | 32.8 | 71.4 | 0.22 |

C) Tests with Embossed Induced Element

The experimental set-up of the tests with simple induced element has been maintained and more embossed induced elements have been made as per the following table

| SAMPLES | DESCRIPTION | TOTAL SP | MF | MA | AA |
|---|---|---|---|---|---|
| Sample 401 | Embossed aluminium having depressions with width of 2.5 mm; height lower than 430 μm, higher than 63 μm | 650 μm | Fe 0.31% | Al 99.64% | rem. |
| Sample 402 | Embossed aluminium as per sample 135, height reduced to 1 mm | 200 μm | Fe 1.12% | Al 98.3% | rem. |
| Sample 403 | Embossed aluminium concertina fold having pitch of 5 mm and height 2 mm | 200 μm | Fe 1.13% | Al 98.48% | rem. |
| Sample 301 | Aluminium 40 μm + polyethylene 20 μm + aluminium 40 μm coupled element; embossed with herringbone pattern having strip length of 2 mm, angle 30° C. | 100 μm | Fe 1.39% | Al 98.36% | rem. |
| Sample 302 | Aluminium 360 μm + air 1-2 μm + aluminium 360 μm coupled element with random embossing | | Fe 0.557% | Al 98.64% Si 0.678% | rem. |

| SAMPLE | EMBOSSING (AND COUPLED ELEMENT) DESCRIPTION | TOTAL SPs |
|---|---|---|
| Sample 401 | Embossed aluminium having depressions with width of 2.5 mm; height lower than 430 μm, higher than 63 μm | 650 μm |
| Sample 402 | Embossed aluminium as per sample 135, height reduced to 1 mm | 200 μm |
| Sample 403 | Embossed aluminium concertina fold having pitch of 5 mm and height 2 mm | 200 μm |
| Sample 301 | Aluminium 40 μm + polyethylene 20 μm + aluminium 40 μm coupled element; embossed with herringbone pattern having strip length of 2 mm, angle 30° C. | 100 μm |
| Sample 302 | Aluminium 360 μm + air 1-2 μm + aluminium 360 μm coupled element with random embossing | 722 μm |

Results

| SAMPLES | Average power (watt) | Initial T (° C.) | Final T (° C.) | Watt h |
|---|---|---|---|---|
| Sample 401 | 24.3 | 36.1 | 55.6 | 0.20 |
| Sample 402 | 39.8 | 44.3 | 177.3 | 0.33 |
| Sample 403 | 36.4 | 42.5 | 170.4 | 0.30 |
| Sample 301 | 23.0 | 35.0 | 38.0 | 0.19 |
| Sample 302 | 20.0 | 31.7 | 36.1 | 0.17 |

Furthermore, in some embodiments, it is possible to place an induced element 13 on both sides of the induction element 11. In this case, a second dielectric element 12 will be placed between the induction element 11 and the second induced element 13.

Furthermore, in some embodiments, it will be possible to provide a layer of adhesive material on the induced element 13, to ease the adhesion thereof. The adhesive material can have thickness from 3 to 100 μm.

FIGS. 5A-5G schematically depicts different embodiments of the induced element 13-13G.

Figure 5A:
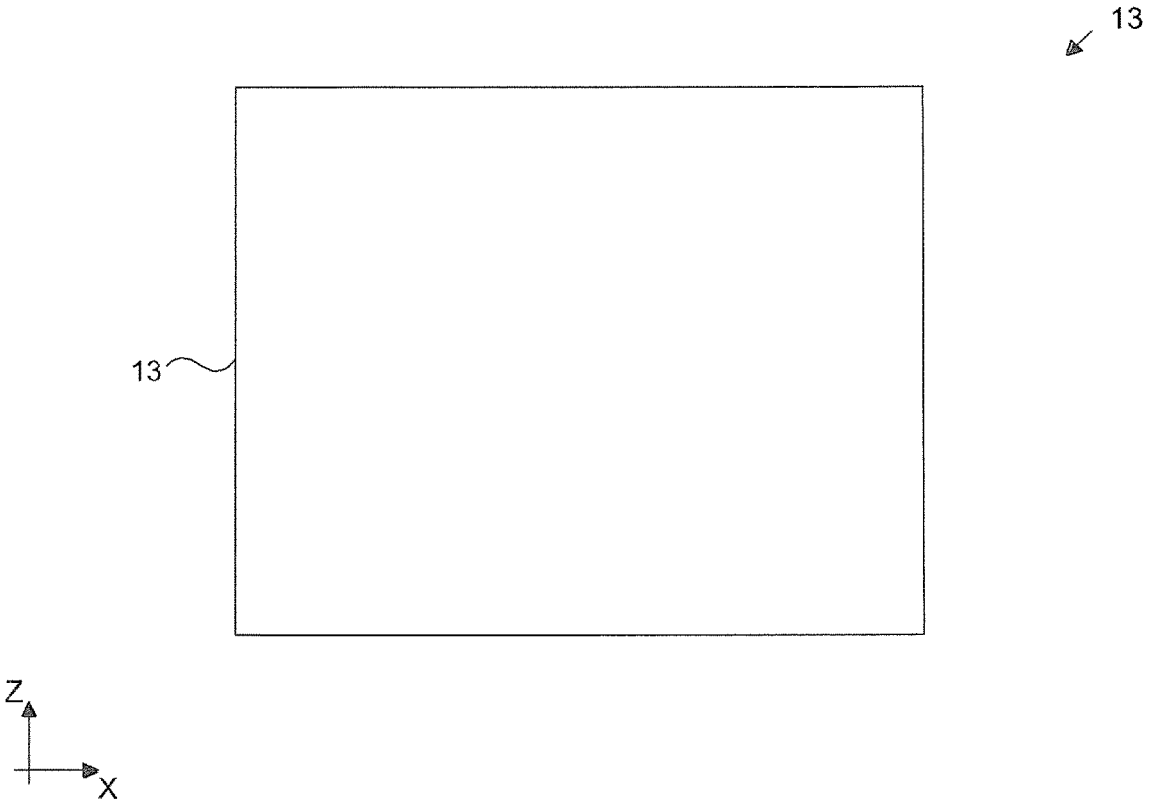
FIGS. 5A-5G schematically show top views of different induced elements according to different embodiments of the present invention.

In particular, in FIG. 5A, the induced element 13 has the shape of a flat film or foil, as previously described.

Figure 5B:
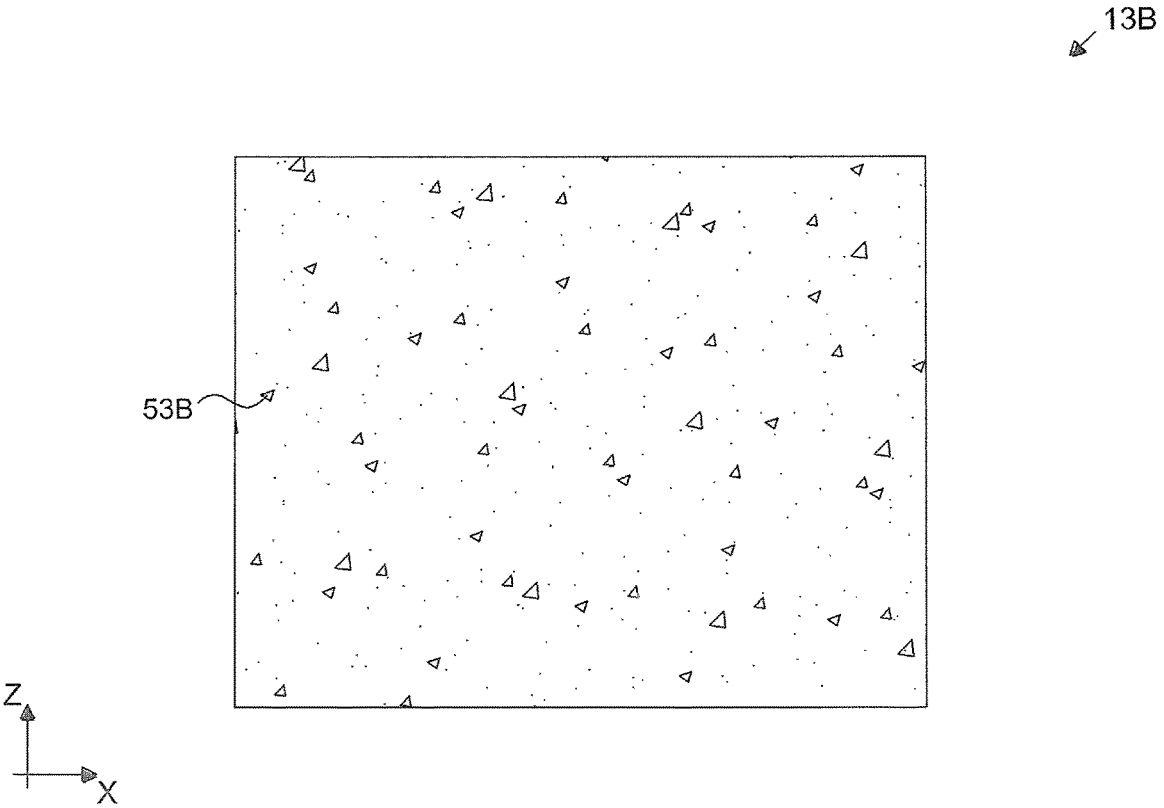

In FIG. 5B, the induced element 13B shows an embossing 53B increasing the exchange surface with the magnetic field generated by the induction element 11.

Figure 5C:
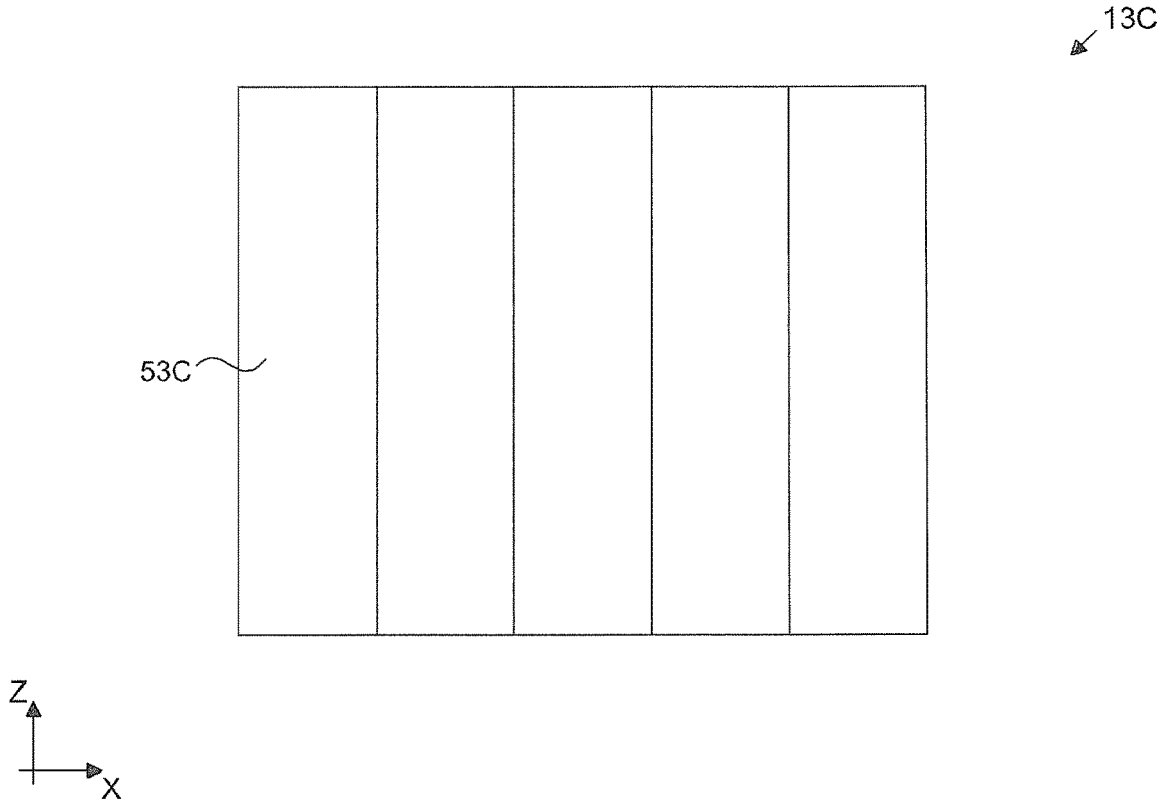
Figure 5D:
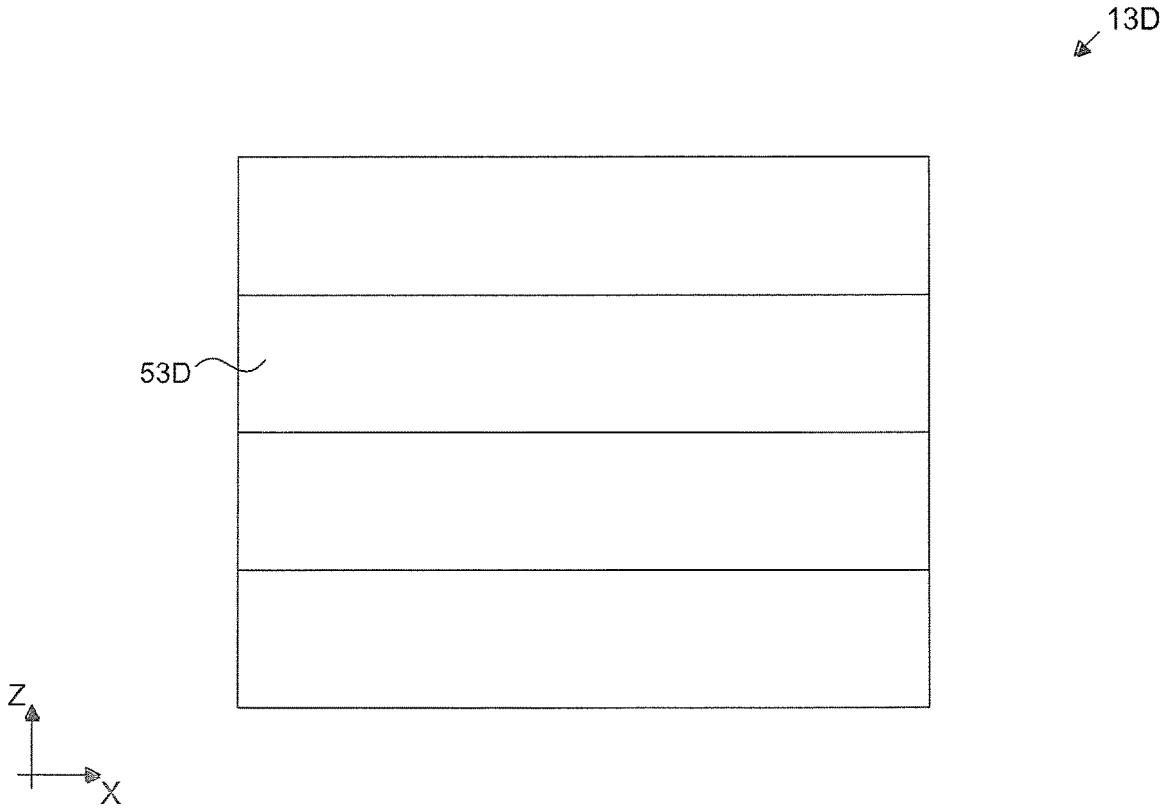
Figure 5E:
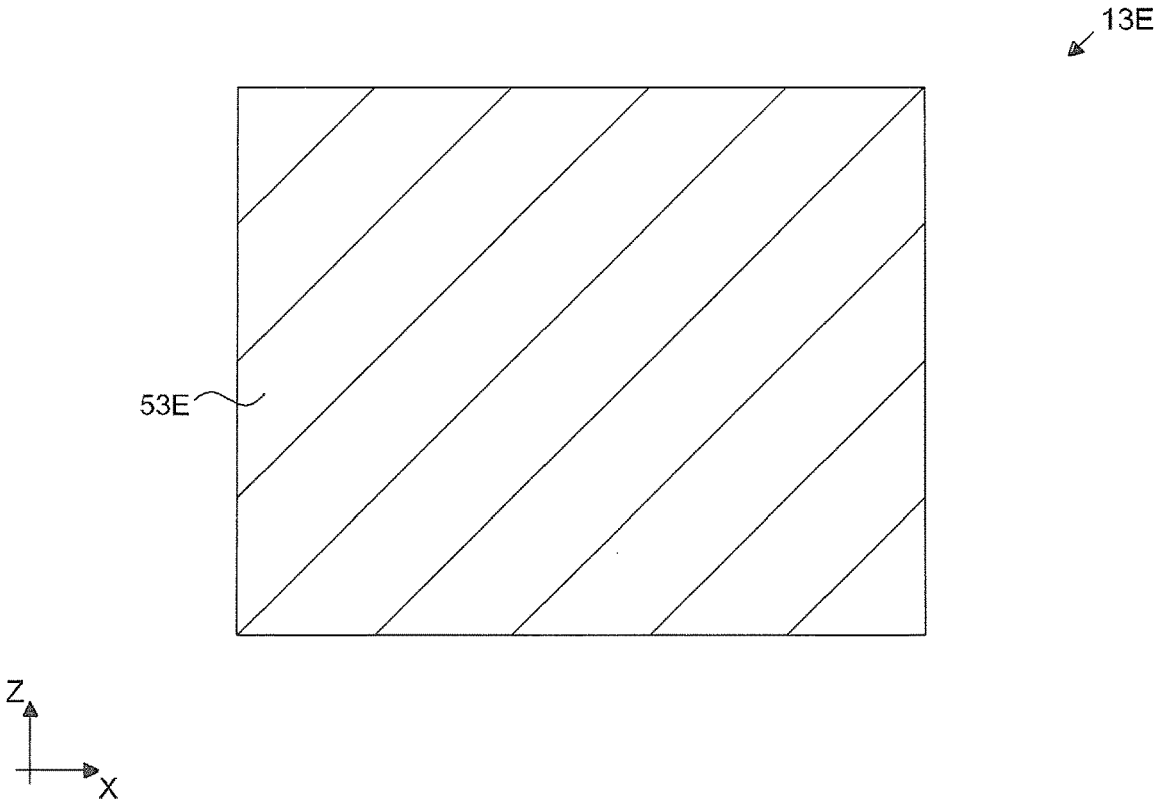

In FIGS. 5C-5E, the induced elements 13C-13E can be constituted by flanked or overlapped or crossed stripes 53C-53E of induced element, which have the same or different dimension, the same or different relative spacing, in a single layer or multilayer, and orientation respectively vertical, horizontal, and oblique. Each of the foils 53C-53E can be made as previously described for the single foil, or film, and subsequently joined to the others. In some specific embodiments, each of the foils can have the smallest dimension typically between 4 μm and 3 cm.

Figure 5F:
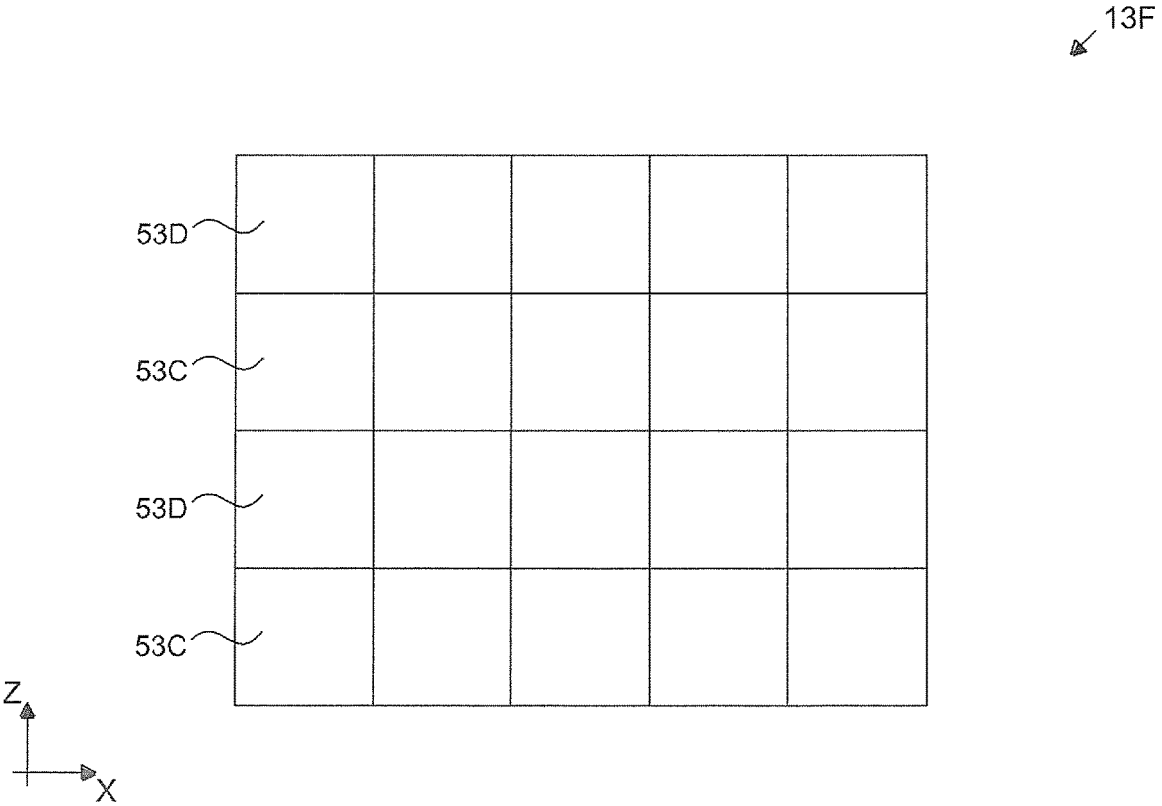

In FIG. 5F, the induced element 13F is made by crossing and overlapping the horizontal foils 53D and the vertical foils 53C.

Figure 5G:
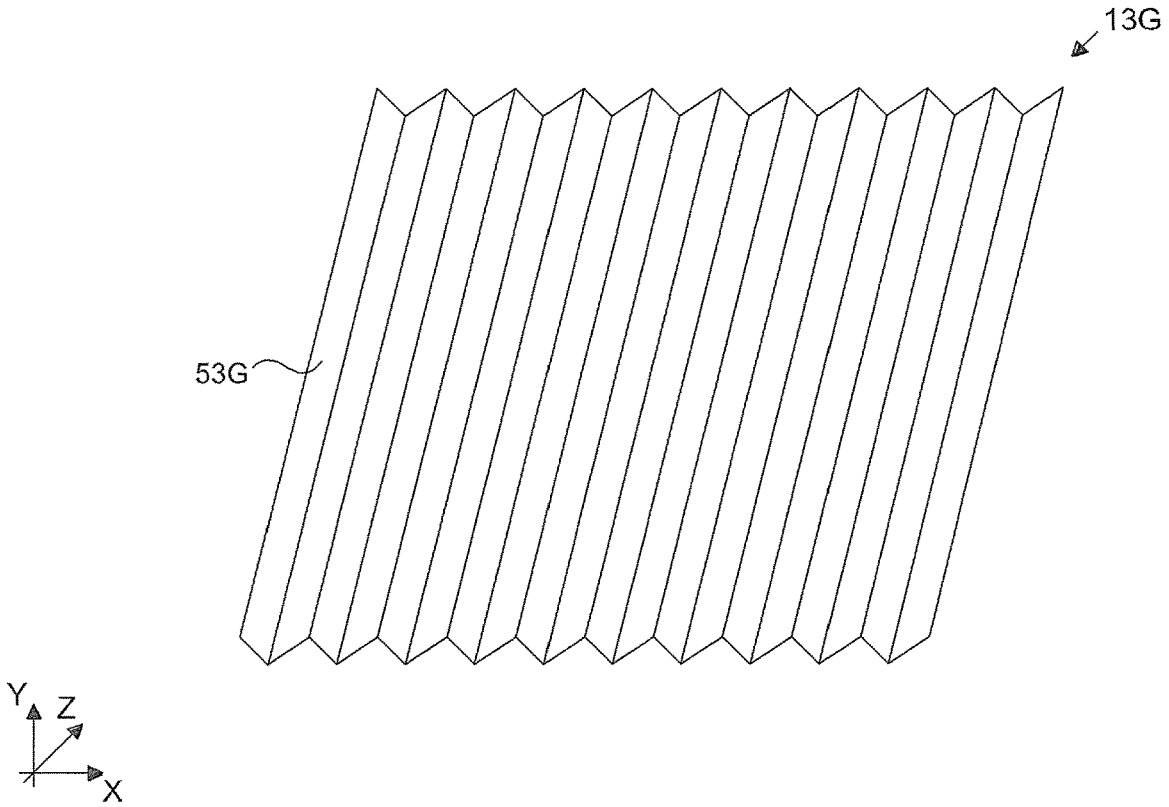

In FIG. 5G, the induced element 13G is made by compacting the concertina fold foils.

Thus, thanks to the described embodiments, it is possible to make a heating device particularly advantageous for the room heating and that can be easily integrated in building elements, or else for making a heating or food cooking device having high efficiency.

Furthermore, in an embodiment, the induction heating device can show convex shape. In particular, at least the induced element can show convex surface, preferably substantially closed on itself, or anyway having an angle of at least 180°. In other words, the induction heating device is not flat but shows a shape at least partially closed on itself.

In some embodiments, also the induction element 11, or the surface defined by the induction element 11, can have convex surface, with considerations similar to those made for the induced element. The same is true for any one of the dielectric elements 12, 31 and 41.

Figure 6:
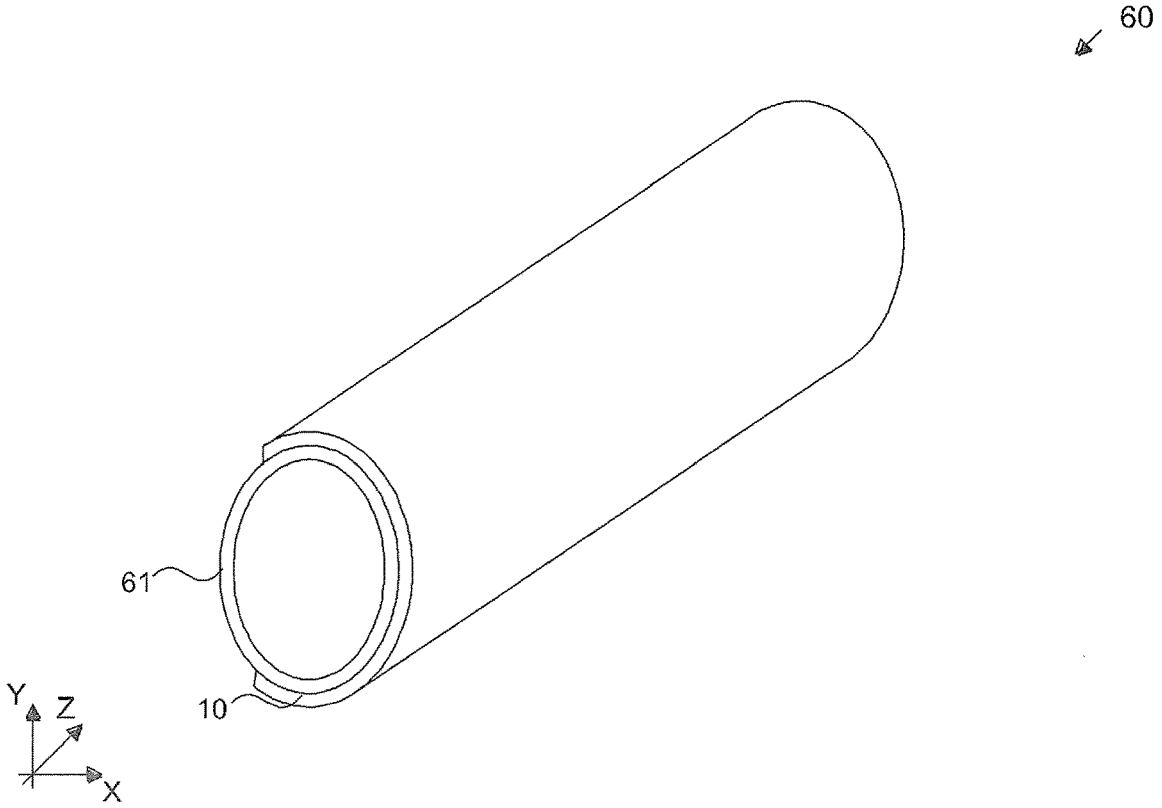
FIG. 6 schematically shows a tridimensional view of an induced element according to an embodiment of the present invention.

More specifically, as depicted in FIG. 6, an induction heating device 60 can have a substantially tubular shape obtained by winding any one of the heating devices previously described, in case above a supporting tube 61. The dimensions of the radius can typically be from 5 mm to 1 m. The section of the supporting tube 61 can be circular, oval, or polygonal, or more in general any section showing at least one convex surface.

In some embodiments, as the depicted one, the supporting tube 61 can be completely closed on 360 degrees in the XY plane, whereas the induction heating device 10 placed on the supporting tube 61 can only be closed partially on itself in the XY plane, i.e. can show a convex surface defining an angle lower than 360 degrees, but preferably higher than 180 degrees.

In other embodiments, the supporting tube can be absent and the induction heating device 60 can be obtained by closing the induction heating device 10 on itself, or any one of the induction heating devices described, so that to form a tube.

Thanks to the induction heating device 60 it is possible, for example, for fluid to flow, such as air, more generally gas, water or oil, or else solids such as grains or powders inside the device 60, by heating them.

In case wherein the device 60 is obtained without a supporting tube 61, the fluids or solids flow directly in contact with the innermost layer of the device, for example the induced element 13 or the dielectric element 41.

On the contrary, in case wherein the supporting tube 61 is present, the fluids or solids could be uniquely in contact with the supporting tube 61, in case wherein the heating device 10 is placed outside to the supporting tube 61 to integrally or partially cover the supporting tube 61 as depicted in FIG. 6, or they will be, integrally or partially, in contact with the heating device 10 in case wherein the heating device 10 is placed inside the supporting tube 61, thus integrally or partially covering it. In case wherein the heating device 10 is placed outside the supporting tube 61, it is advantageously possible to circulate fluids or solids, inside the supporting tube 61, that could corrode or compromise the operation of the device 60.

In some embodiments, the supporting tube 61 can be, for example, a plastic tube, a tube for piping made of PVC, a tube of drinking water or a glass tube, for example for applications in the laboratory glassware.

Figure 7:
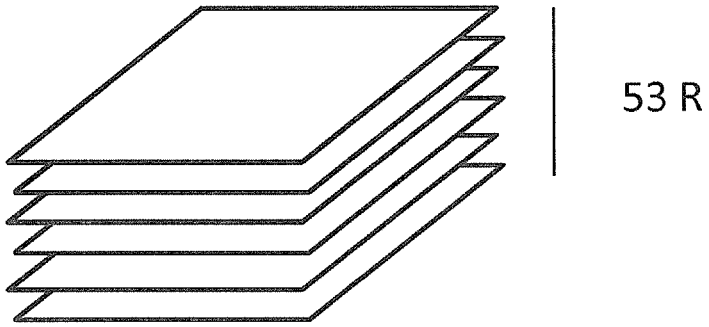
FIG. 7 schematically shows a tridimensional view of an induced element according to an embodiment of the present invention, having overlapped foils.

In FIG. 7 the induced element composed of overlapped foils 53R is depicted in a tridimensional form. Between one foil and the other one it is possible to provide the presence of a dielectric element, preferably air.

EXAMPLE

Example 10

The induced element 13 is any one of the induced elements previously described.

The induced element 13 shows a circular section having diameter of 80 mm and length of 60 cm. The foil constituting the tube is concertina fold to ease the induction element 11 constituted by enameled copper wire having diameter of 1.2 mm, to be housed.

A power of 60 W, a voltage of 30 V and a current of 2 ampere have been applied. The thermography detected a temperature of 50° C. inside the tube, reached in less than 10 minutes.

An embodiment of the present invention is further referring to a kit for making a device according to any one of the previous embodiments and comprises an induction element 11, and/or an induced element 13, and/or a first dielectric element 12 to be placed between the induction element 11 and the induced element 13. In particular, one or more of these three elements can be provided separately and assembled only during installation and/or use of the device.

In the described embodiments, the induction heating device comprises at least one induction element 11 and one induced element 13. However it will be clear that, particularly considering the thicknesses that can be obtained with the previously described materials, it is possible to make induction heating devices in which there are more layers of induction elements 11 and/or induced elements 13. For example, a single induced element 13 could be combined with two induction elements 11, one per side of the induced element 13, to double the available power. Alternatively, for example, a single induction element 11 could be combined with two induced elements 13, on the same side or else one per side of the induction element 11, to heat both sides of the device.

Despite different embodiments have been described separately, it will be apparent to the expert in the art that they can be combined to one another, without necessarily combine all of the characteristics thereof but only those needed to obtain a desired effect.

LIST OF THE NUMERAL REFERENCES

10: induction heating device
11: induction element
12: dielectric element
13: induced element
13B: induced element
13C: induced element
13D: induced element
13E: induced element
13F: induced element
13G: induced element
14: conductive element
14A: end
14B: end

15: conductive element
15A: end
15B: end
16: conductive element
17: conductive element
18: conductive element
19: conductive element
30: induction heating device
31: dielectric element
40: induction heating device
41: dielectric element
53B: embossing
53C: foil
53D: foil
53E: foil
53G: foil
53R: overlapped foils
60: induction heating device
61: supporting tube

What is claimed is:

1. A heating device comprising:
an induction element,
an induced element, and
a first dielectric element placed between the induction element and the induced element,
where the induced element comprises a metal alloy containing a first metal, or a first mixture of metals, in a percentage in the range 90%-99.99% by weight to the total weight and containing a second metal, or a second mixture of metals, in a percentage in the range 0.01%-10% by weight to the total weight;
characterized in that the first metal is an amagnetic metal, or in that the first mixture of metals is amagnetic or exclusively comprises non-magnetic metals, and
in that the second metal is a ferromagnetic or ferrimagnetic metal, or in that the second mixture of metals is magnetic or exclusively comprises ferromagnetic or ferrimagnetic metals.

2. The heating device according to claim 1, wherein the induced element has thickness between 5 μm and 700 μm.

3. The heating device according to claim 1, wherein the alloy contains less than 1% by weight of:
one or more rare-earth elements; wherein the rare-earth elements are identified according to IUPAC definition, or an oxide of the rare-earth elements, or else misch metal composed of cerium 50%, lanthanum 25% and a balance of neodymium and praseodymium; and
non-metals.

4. The heating device according to claim 1, wherein;
the first metal is one among gold, silver, copper, aluminum, platinum, boron, or wherein the first mixture is a mixture of two or more among gold, silver, copper, aluminum, platinum, boron, and
the second metal is one among nickel, iron, cobalt, or the second mixture is of two or more among nickel, iron, cobalt.

5. The heating device according to claim 1, wherein the induction element comprises a first conductive element of which at least part has spiral shape.

6. The device according to claim 1, wherein the first dielectric element has thickness from 1 cm to 10 cm.

7. The heating device according to claim 1, further comprising: a third dielectric element placed on the induced element at the side opposite to the first dielectric element.

8. The heating device according to claim 1, wherein the first dielectric element and/or a second dielectric element and/or a third dielectric element comprise/s one or more materials taken from the group comprising: plastic material, polymers, resin, glass, ceramic, wood, conglomerate of powdered oxides, stone.

9. The heating device according to claim 1, wherein the induced element comprises an embossing.

10. The heating device according to claim 1, wherein the induced element has previously undergone an anodizing process.

11. The heating device according to claim 1, wherein the induced element comprises a plurality of foils.

12. The heating device according to claim 1, wherein the induced element, or the induced element, the first dielectric, and the induction element each comprise a convex or concave surface.

13. A kit for making the heating device according to claim 1, comprising:
an induction element, and
an induced element, and
a first dielectric element to be placed between the induction element and the induced element, where the induced element comprises a metal alloy containing a first metal or a first mixture of metals in a percentage in the range 90%-99% by weight to the total weight and containing a second metal or a second mixture of metals in a percentage in the range 1%-10% by weight to the total weight;
characterized in that the first metal is an amagnetic metal, for example diamagnetic or paramagnetic or antiferromagnetic metal, or in that the first mixture of metals is amagnetic or exclusively comprises non-magnetic metals, and
in that the second metal is a ferromagnetic or ferrimagnetic metal, or in that the second mixture of metals is magnetic or exclusively comprises ferromagnetic or ferrimagnetic metals.

14. The kit according to claim 13, wherein the induced element, or the induced element, the first dielectric, and the induction element each comprise a convex or concave surface.

15. The kit according to claim 13, wherein the induced element comprises a plurality of foils.

16. The kit according to claim 13, wherein the induced element foils are parallel and/or cross one another.

17. The device according to claim 1, wherein the induced element has thickness between 5 μm and 200 μm.

* * * * *